US009171502B2

(12) United States Patent
Tomida et al.

(10) Patent No.: US 9,171,502 B2
(45) Date of Patent: Oct. 27, 2015

(54) PIXEL SELECTION CONTROL METHOD, DRIVING CIRCUIT, DISPLAY APPARATUS AND ELECTRONIC INSTRUMENT

(71) Applicant: Sony Corporation, Tokyo (JP)

(72) Inventors: Masatsugu Tomida, Kanagawa (JP); Keisuke Omoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/541,374

(22) Filed: Nov. 14, 2014

(65) Prior Publication Data

US 2015/0070335 A1 Mar. 12, 2015

Related U.S. Application Data

(63) Continuation of application No. 12/785,546, filed on May 24, 2010, now Pat. No. 8,922,462.

(30) Foreign Application Priority Data

Jun. 4, 2009 (JP) ..... 2009-134786

(51) Int. Cl.
*G09G 3/30* (2006.01)
*G09G 3/32* (2006.01)

(52) U.S. Cl.
CPC ..... *G09G 3/3225* (2013.01); *G09G 3/3233* (2013.01); *G09G 3/3266* (2013.01); *G09G 2300/08* (2013.01); *G09G 2300/0819* (2013.01); *G09G 2300/0842* (2013.01); *G09G 2300/0861* (2013.01); *G09G 2300/0866* (2013.01); *G09G 2310/0283* (2013.01); *G09G 2310/0289* (2013.01); *G09G 2320/0223* (2013.01); *G09G 2320/043* (2013.01)

(58) Field of Classification Search
CPC ..... G09G 3/32; G09G 3/3225; G09G 3/3266; G09G 3/3233
USPC ..... 345/204–215
See application file for complete search history.

(56) References Cited

U.S. PATENT DOCUMENTS

| | | | | |
|---|---|---|---|---|
| 2002/0089476 | A1 | 7/2002 | Kang | |
| 2005/0175138 | A1 | 8/2005 | Matsuda et al. | |
| 2006/0210012 | A1 | 9/2006 | Yamaguchi et al. | |
| 2007/0040793 | A1 | 2/2007 | Kim et al. | |
| 2007/0115239 | A1 * | 5/2007 | Yonemochi | 345/98 |
| 2007/0195920 | A1 | 8/2007 | Tobita | |
| 2008/0246698 | A1 * | 10/2008 | Eom | 345/76 |
| 2009/0033642 | A1 | 2/2009 | Chiang et al. | |
| 2009/0201231 | A1 | 8/2009 | Takahara et al. | |
| 2009/0207193 | A1 | 8/2009 | Isobe et al. | |
| 2009/0219231 | A1 | 9/2009 | Yamamoto et al. | |
| 2010/0309174 | A1 | 12/2010 | Tomida et al. | |
| 2010/0309178 | A1 | 12/2010 | Tomida et al. | |

FOREIGN PATENT DOCUMENTS

| | | |
|---|---|---|
| JP | 2006-133542 | 5/2006 |
| JP | 2008-102223 | 5/2008 |
| JP | 2008-286963 | 11/2008 |

* cited by examiner

*Primary Examiner* — Kevin Nguyen
*Assistant Examiner* — Cory Almeida
(74) *Attorney, Agent, or Firm* — Wolf, Greenfield & Sacks, P.C.

(57) ABSTRACT

A pixel selection control method, driving circuit, display apparatus and electronic instrument are disclosed. A driving circuit includes a logic circuit configured to receive a reference signal associated with a line of pixels. The reference signal has a first logic level or a second logic level. The driving circuit also includes a switch circuit configured to receive the reference signal and an enable signal, and to provide the enable signal to the logic circuit when the reference signal is at the first logic level. A display apparatus may be provided that includes the driving circuit.

12 Claims, 23 Drawing Sheets

NOT AFTER t = t11 t = t11 t = t12 t = t13 t = t14 t = t15 t = t16 t = t17

FIG.17
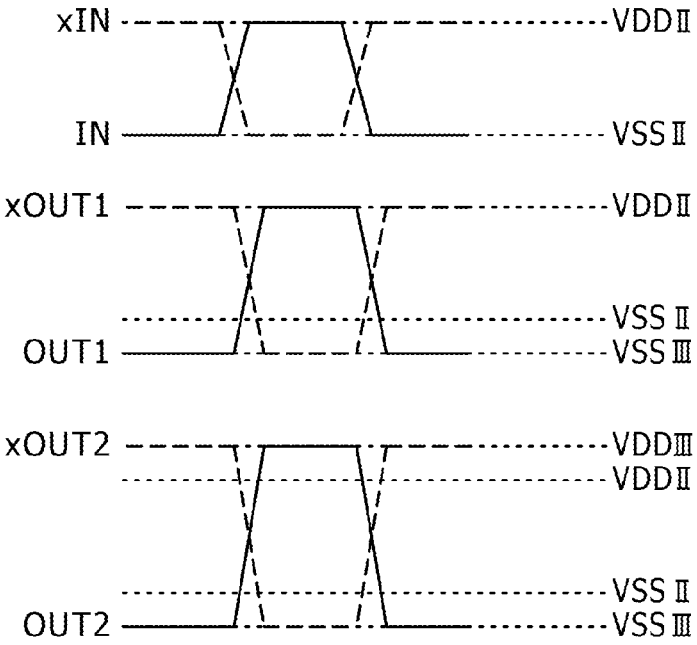
FIG.18
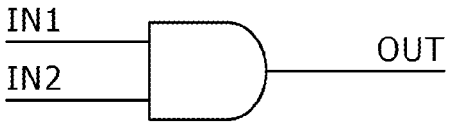
FIG.19
| IN1 | IN2 | OUT |
|---|---|---|
| L | L | L |
| L | H | L |
| H | L | L |
| H | H | H |

PIXEL SELECTION CONTROL METHOD, DRIVING CIRCUIT, DISPLAY APPARATUS AND ELECTRONIC INSTRUMENT

CROSS REFERENCE TO RELATED APPLICATIONS

This application is a continuation of and claims the benefit under 37 U.S.C. §120 of U.S. patent application Ser. No. 12/785,546, titled "PIXEL SELECTION CONTROL METHOD, DRIVING CIRCUIT, DISPLAY APPARATUS AND ELECTRONIC INSTRUMENT," filed May 24, 2010, which claims the benefit under 37 U.S.C. §119 of Japanese Patent Application 2009-134786, filed on Jun. 4, 2009, each of which is hereby incorporated by reference in its entirety.

BACKGROUND OF THE INVENTION

1. Field of the Invention

In general, the present invention relates to a pixel selection control method, driving circuit, display apparatus and electronic instrument. More particularly, the present invention relates to a flat-panel display apparatus employing pixels which each include an electro-optical device and are laid out 2-dimensionally to form a matrix, relates to a method for driving the display apparatus and relates to electronic apparatus each having the display apparatus.

2. Description of the Related Art

The existing display apparatus employs pixels which each include an electro-optical device and are laid out 2-dimensionally to form a pixel matrix. The display apparatus has a row scan section for selecting pixels laid out along a pixel row of the pixel matrix by activating a scan line connected to the pixels laid out along the pixel row. That is to say, the row scan section selects pixels in row units. Typically, the row scan section employs a shift register or a decoder and a level conversion circuit which is also referred to as a level shift circuit. The level shift circuit is a circuit for changing the amplitude of a scan signal output by the shift register or the decoder to an amplitude which is required for driving the electro-optical devices. The level shift circuit is provided for every pixel row of the matrix or every scan line.

With a level shift circuit provided for every scan line as described above, however, the timing of a scan signal generated by a level shift circuit is different from the timing of a scan signal generated by another level shift circuit. This difference in timing between scan signals generated by different level shift circuits is caused by variations of characteristics of the same circuit devices employed in the different level shift circuits. This difference in timing between scan signals generated by different level shift circuits has a variety of bad effects on the image displayed by the display apparatus.

In order to solve the problem raised by the existing display apparatus as described above, the scan signals are provided with a common enable signal for prescribing rising and falling timings of every scan signal. In such a configuration, the enable signal and the scan signals are subjected to logic processing in order to eliminate variations of timing between the scan signals which are generated by different level shift circuits. For details, the reader is suggested to refer to documents such as Japanese Patent Laid-open No. 2008-286963.

FIG. 30 is a block diagram showing a typical configuration of a row scan section 300 employed in the existing display apparatus. As shown in FIG. 30, the row scan section 300 employed in the existing display apparatus has level shift circuits 301, 302 and 303, a shift register section 304, a first logic circuit section 305, a level shift circuit section 306, a second logic circuit section 307 and a buffer section 308. In order to make FIG. 30 simple, the typical configuration of the row scan section 300 is shown to include sections provided for four pixel rows which start with the first pixel row.

In the typical configuration shown in FIG. 30, shift signals are output sequentially from unit circuits of the shift register section 304. In the following description, each of the shift signals is also referred to as a reference signal. Each of the unit circuits is also referred to as an S/R (shift register) or a transfer register. The shift register section 304 supplies the shift signals to the second logic circuit section 307 by way of the first logic circuit section 305 and the level shift circuit section 306. The level shift circuit section 306 changes the amplitude of each of the shift signals to an amplitude which is required for driving electro-optical devices not shown in FIG. 30. The level shift circuit section 306 supplies every signal having the amplitude required for driving electro-optical devices to a specific input node of each of AND gates 307-1 to 307-4 which are employed in the second logic circuit section 307.

The other input node of each of the AND gates 307-1 to 307-4 is connected to a common transmission line SL which is provided to serve as a line common to all pixel rows. The common transmission line SL is used for supplying a vertical enable signal VEN, the level of which has been changed by the level shift circuit 303. Each of the AND gates 307-1 to 307-4 generates a scan signal which represents the logical product of the shift signal and the vertical enable signal VEN. That is to say, the second logic circuit section 307 sequentially generates scan signals with rising and falling timings which are determined by the vertical enable signal VEN. The second logic circuit section 307 supplies the scan signals to their respective row scan lines for their respective pixel rows by way of the buffer section 308. It is to be noted that the row scan lines are not shown in FIG. 30.

SUMMARY OF THE INVENTION

In the row scan section 300 having the configuration described above, an original vertical enable signal VEN supplied to the level shift circuit 303 is a pulse signal which rises and falls down once a 1H which is a horizontal scan period. That is to say, the vertical enable signal VEN rises and falls down once with rising and falling timings in 1H. Thus, the vertical enable signal VEN generated by the level shift circuit 303 electrically charges and discharges the common transmission line SL once a 1H.

A capacitor Ctr of a transistor included in each of the AND gates 307-1 to 307-4 is connected to the common transmission line SL. Thus, the capacitance of a total load borne by the common transmission line SL is found by multiplying the number of scan lines by the capacitance of the capacitor Ctr of the transistor. The capacitor Ctr of the transistor is a capacitor created between the gate electrode of the transistor and the channel area of the transistor.

The power consumed in electrical charging/discharging processes for every 1-H period is represented by an expression of $cv^2 \times f$ where notation c denotes the capacitance of a capacitor subjected to the electrical charging/discharging processes, notation v denotes the electrical charging/discharging voltage and notation f denotes the electrical charging/discharging frequency. The power consumption of the common transmission line SL can be found by setting the capacitance c at the capacitance of capacitors Ctr connected to the common transmission line SL. The higher the vertical resolution, that is, the higher the number of scan lines, the larger the capacitance of a total load borne by the common transmission line SL. Thus, the power consumption of the operations caused by the vertical enable signal VEN as operations to electrically charge and discharge the common transmission line SL is larger for a higher vertical resolution.

The description is given here by taking the row scan section as an example. It is to be noted, however, that problems are by no means limited to the problem raised by the scan section. That is to say, in the so-called point-after-point display apparatus, the problem is also raised as well in a column scan section which is provided to serve as a section for individually selecting every pixel pertaining to a pixel row selected by the row scan section. The point-to-point display apparatus is an apparatus which writes a signal individually into every pixel pertaining to a pixel row selected by the row scan section.

Addressing the problems described above, inventors of the present invention have innovated a display apparatus capable of reducing the power consumption of a scan section having a configuration in which an enable signal for prescribing rising and falling timings of each of scan signals is provided to serve as an enable signal common to all the scan signals. The inventors of the present invention have also innovated a driving method for driving the display apparatus and electronic apparatus each employing the display apparatus.

In order to achieve the aim of the embodiments of the present invention addressing the problems described above, several techniques are described herein.

Some embodiments relate to a method of controlling selection of pixels. The method includes receiving a reference signal associated with a line of pixels and an enable signal. The reference signal has a first logic level or a second logic level. A logic operation is performed using the reference signal and the enable signal only when the reference signal has the first logic level. A scan signal is provided to the line of pixels based on a result of the logic operation.

Some embodiments relate to a driving circuit for controlling selection of pixels. The driving circuit includes a logic circuit configured to receive a reference signal associated with a line of pixels. The reference signal has a first logic level or a second logic level. The driving circuit also includes a switch circuit configured to receive the reference signal and an enable signal, and to provide the enable signal to the logic circuit when the reference signal is at the first logic level.

Some embodiments relate to a display apparatus that includes a plurality of pixels. Each pixel includes a light emitting element. The display apparatus also includes a driving circuit comprising a logic circuit configured to receive a reference signal associated with a line of pixels. The reference signal has a first logic level or a second logic level. The driving circuit also includes a switch circuit configured to receive the reference signal and an enable signal, and to provide the enable signal to the logic circuit when the reference signal is at the first logic level.

Some embodiments relate to an electronic instrument that includes a display apparatus having a plurality of pixels. Each pixel includes a light emitting element. The display apparatus also includes a driving circuit comprising a logic circuit configured to receive a reference signal associated with a line of pixels. The reference signal has a first logic level or a second logic level. The driving circuit also includes a switch circuit configured to receive the reference signal and an enable signal, and to provide the enable signal to the logic circuit when the reference signal is at the first logic level.

In the display apparatus, it is during a time period used for generating any specific one of the reference signals to be supplied to their respective logic circuits that an input node formed on the logic circuit provided for the specific reference signal to serve as an input node for receiving the enable signal is electrically connected to the common transmission line.

The reference signal used as the reference of a scan signal as described above is a reference signal from which the scan signal is generated as will be explained later in detail.

As obvious from the above description, each of the logic circuits has an enable-signal receiving input node which is an input node for receiving the enable signal. It is during a time period used for generating any specific reference signal to be supplied to a specific logic circuit that the enable-signal receiving input node of the specific logic circuit is electrically connected to the common transmission line. Thus, the enable signal is supplied to a logic circuit synchronously with a reference signal received by the logic circuit. During the time period used for generating the specific reference signal, the logic circuit receiving the specific reference signal is the logic circuit having the enable-signal receiving input node thereof electrically connected to the common transmission line. Thus, in comparison with a configuration in which the enable-signal receiving input node of every logic circuit is electrically connected to the common transmission line, the capacitance of a total load borne by the common transmission line is reduced to a fraction. To put it more concretely, the capacitance of a total load borne by the common transmission line is 1/m times the capacitance of a total load borne by a common transmission line for a configuration in which the enable-signal receiving input node of every logic circuit is electrically connected to the common transmission line where notation m denotes the number of scan lines. The capacitance of the total load borne by the common transmission line includes the capacitance of a transistor composing each logic circuit electrically connected to the common transmission line. As a result, it is possible to reduce the power consumed in processes of electrically charging and discharging the enable signal into and from the common transmission line. That is to say, the power consumption of the scan section can thus be decreased.

In accordance with the present invention, in a scan section configured to supply an enable signal for prescribing rising and falling timings of a scan signal to serve as an enable signal common to all reference signals, it is possible to reduce the capacitance of a total load borne by the common transmission line for transmitting the enable signal. Thus, the power consumption of the scan section can be decreased.

This summary is presented by way of illustration and is not intended to be limiting.

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

FIG. 17 is a timing/waveform diagram showing the waveforms of an input signal IN and an inverted input signal xIN, an intermediate output signal OUT1 and an inverted intermediate output signal xOUT1 in the typical level shift circuit shown in the circuit diagram of FIG. 16;

FIG. 18 is a diagram showing the symbol of each 2-input AND gate serving as a 2-input logical-product circuit employed in a second logic section;

FIG. 19 is a diagram showing the truth table of the 2-input AND gate also referred to as a 2-input AND circuit;

DETAILED DESCRIPTION OF THE PREFERRED EMBODIMENTS

Next, by referring to the diagrams, the following description explains details of preferred embodiments which each implement the present invention. It is to be noted that the embodiments are explained in paragraphs of chapters which are arranged as follows.

1: Organic EL Display Apparatus According to the Invention

2: Characteristics of Embodiments 2-1: First Embodiment (Nch MOS transistors serving as switching devices)

2-2: Second Embodiment (Nch and Pch CMOS transistors serving as switching devices)

2-3: Third Embodiment (Pch MOS transistors serving as switching devices)

3: Modified Versions

4: Typical Applications (Electronic apparatus)

1: Organic EL Display Apparatus According to the Invention System Configuration

Figure 1:
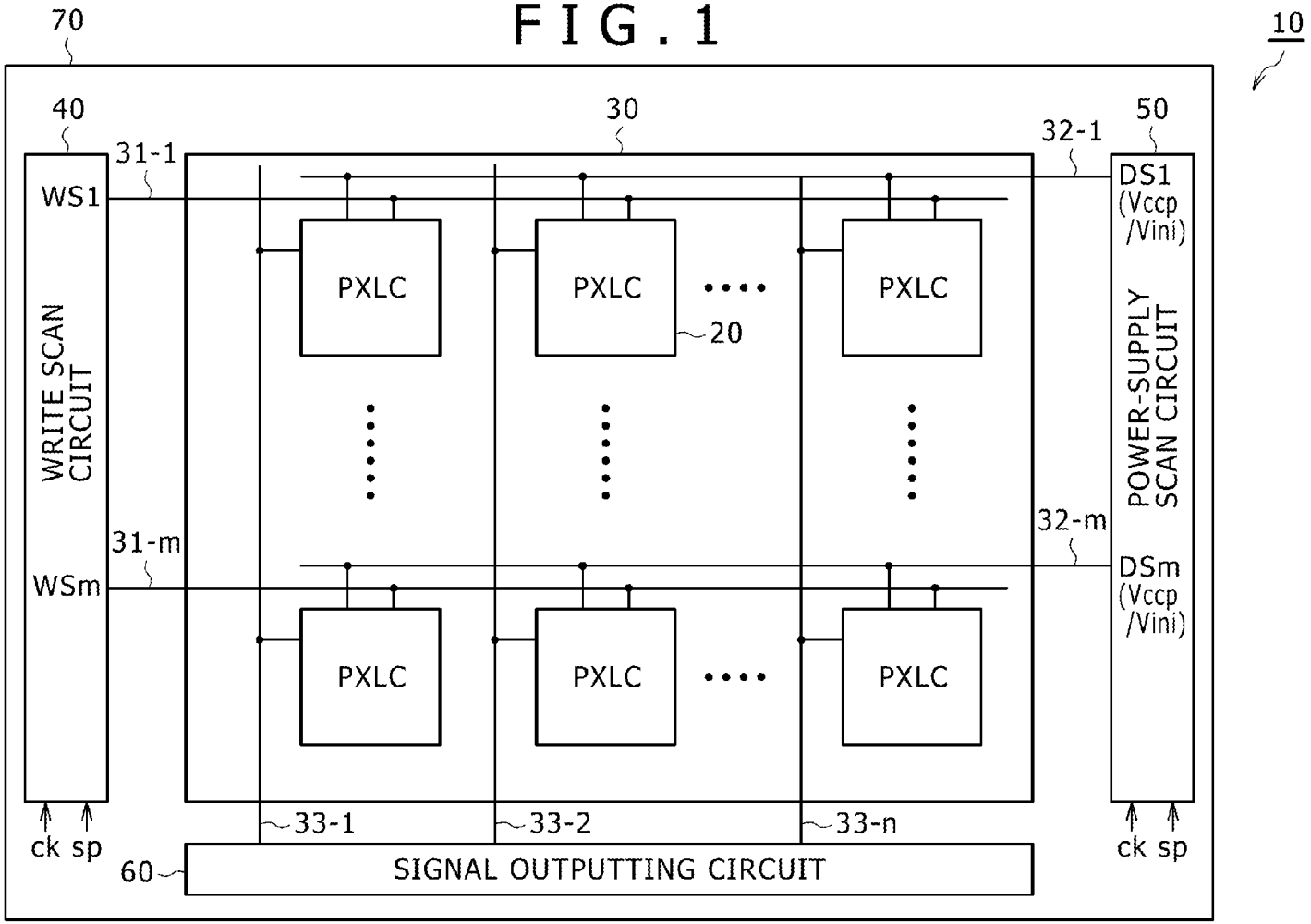
FIG. 1 is a block diagram showing a rough configuration of an active-matrix organic EL display apparatus to which embodiments of the present invention is applied.

FIG. 1 is a system-configuration diagram showing a rough configuration of an active-matrix type display apparatus to which the embodiments of the present invention is applied.

The active matrix display apparatus is an apparatus which makes use of active devices each utilized for controlling a current flowing through an electro-optical device provided in the same pixel as the active device. A typical example of the active device is an insulated-gate field electric transistor. The insulated-gate field electric transistor is typically a TFT (Thin Film Transistor).

As an example, each pixel circuit employed in the active-matrix type display apparatus has a current-driven light emitting device serving as an electro optical device which emits light at a luminance determined by the magnitude of a driving current flowing through the electro optical device. A typical example of such an electro optical device is an organic EL device. The display apparatus employing pixel circuits each having an organic EL device serving as a light emitting device is referred to as an active-matrix type organic EL display apparatus which is explained below as a typical active-matrix type display apparatus.

As shown in FIG. 1, an organic EL display apparatus 10 serving as a typical example of the active-matrix type display apparatus employs a pixel matrix section 30 and driving sections provided at locations surrounding the pixel matrix section 30 as driving sections each used for driving a plurality of pixel circuits (PXLCs) 20 employed in the pixel matrix section 30. In the pixel matrix section 30, the pixel circuits 20 each including a light emitting device are arranged 2-dimensionally to form a pixel matrix.

The driving section employs a write scan circuit 40, a power-supply scan circuit 50 and a signal outputting circuit 60. The driving section is a section for driving pixel circuits 20 of the pixel array section 30. Each of the write scan circuit 40 and the power-supply scan circuit 50 is a row scan section for selecting pixel circuits 20 in pixel-row units.

In the case of an active-matrix organic EL display apparatus 10 for showing a color display, each of the pixel circuits 20 includes a plurality of sub-pixel circuits each functioning as a pixel circuit 20. To put it more concretely, in an active-matrix organic EL display apparatus 10 for showing a color display, each of the pixel circuits 20 includes three sub-pixel circuits, i.e., a sub-pixel circuit for emitting red light (that is, light of the R color), a sub-pixel circuit for emitting green light (that is, light of the G color) and a sub-pixel circuit for emitting blue light (that is, light of the B color).

However, combinations of sub-pixel circuits each functioning as a pixel circuit are by no means limited to the above combination of the sub-pixel circuits for the three primary colors, i.e., the R, G and B colors. For example, a sub-pixel circuit of another color or even a plurality of sub-pixel circuits for a plurality of other colors can be added to the sub-pixel circuits for the three primary colors to function as a pixel circuit. To put it more concretely, for example, a sub-pixel circuit for generating light of the white (W) color for increasing the luminance can be added to the sub-pixel circuits for the three primary colors to function as a pixel circuit. As another example, sub-pixel circuits each used for generating light of a complementary color can be added to the sub-pixel circuits for the three primary colors to function as a pixel circuit with an increased color reproduction range.

For the m-row/n-column matrix of pixel circuits 20 arranged to form m rows and n columns in the pixel matrix section 30, scan lines 31-1 to **31-*m* and power-supply lines 32-1 and 32-*m* are provided, being oriented in the row direction or the horizontal direction in FIG. 1. The row direction is the direction of every matrix row along which pixel circuits 20 are arranged. To be more specific, each of the scan lines 31-1 to 31-*m* and each of the power-supply lines 32-1 and 32-*m* are provided for one of the m rows of the matrix of pixel circuits 20. In addition, the m-row/n-column matrix of pixel circuits 20 in the pixel matrix section 30 is also provided with signal lines 33-1 to 33-*n* each oriented in the column direction or the vertical direction in FIG. 1. The column direction is the direction of every matrix column along which pixel circuits 20 are arranged. To be more specific, each of the signal lines 33-1 to 33-*n* is provided for one of the n columns of the matrix of pixel circuits 20**.

Any specific one of the scan lines 31-1 to **31-*m* is connected to an output terminal employed in the write scan circuit 40 as an output terminal associated with a row for which the specific scan line 31 is provided. By the same token, any specific one of the power-supply lines 32-1 to 32-*m* is connected to an output terminal employed in the power-supply scan circuit 50 as an output terminal associated with a row for which the specific power-supply line 32 is provided. On the other hand, any specific one of the signal lines 33-1 to 33-*n* is connected to an output terminal employed in the signal outputting circuit 60 as an output terminal associated with a column for which the specific signal line 33** is provided.

The pixel matrix section 30 is normally created on a transparent insulation substrate such as a glass substrate. Thus, the active-matrix organic EL display apparatus 10 can be constructed to have a flat panel structure. Each of the write scan circuit 40, the power-supply scan circuit 50 and the signal outputting circuit 60 each functioning as a driving section configured to drive the pixel circuits 20 included in the pixel matrix section 30 can be composed of amorphous silicon TFTs (Thin Film Transistors) or low-temperature silicon TFTs. If low-temperature silicon TFTs are used, each of the write scan circuit 40, as shown in FIG. 1, the power-supply scan circuit 50 and the signal outputting circuit 60 can also be created on a display panel 70 (or the substrate) composing the pixel matrix section 30.

The write scan circuit 40 includes a shift register for sequentially shifting (propagating) a start pulse sp in synchronization with a clock pulse signal ck. In an operation to write video signals into the pixel circuits 20 employed in the pixel matrix section 30, the write scan circuit 40 sequentially supplies the start pulse sp as one of write pulses (or scan signals) WS1 to WSm to one of the scan lines 31-1 to **31-*m*. The write pulses supplied to the scan lines 31-1 to 31-*m* are thus used for scanning the pixel circuits 20 employed in the pixel matrix section 30 sequentially in row units in the so-called a line-by-line sequential scan operation to put pixel circuits 20 provided on the same row in a state of being enabled to receive the video signals at one time. The write scan circuit 40 is one of the scan sections according to the embodiments of the present invention. That is to say, the embodiments of the present invention characterize the concrete configuration of the write scan circuit 40. Details of the concrete configuration of the write scan circuit 40** will be described later.

By the same token, the power-supply scan circuit 50 also includes a shift register for sequentially shifting (propagating) a start pulse sp in synchronization with a clock pulse signal ck. In synchronization with the line-by-line sequential scan operation carried out by the write scan circuit 40, that is, with timings determined by the start pulse sp, the power-supply scan circuit 50 supplies power-supply line electric potentials DS1 to DSm to the power-supply lines 32-1 to **32-*m* respectively. As described later, each of the power-supply line electric potentials DS1 to DSm is switched from a first power-supply electric potential Vccp to a second power-supply electric potential Vini lower than the first power-supply electric potential Vccp and vice versa in order to control the light emission state and no-light emission state of the pixel circuits 20 in row units and in order to supply a driving current to organic EL devices, which are each employed in the pixel circuit 20** as a light emitting device, in row units.

The signal outputting circuit 60 is a section for selectively outputting a signal voltage Vsig or a reference electric potential Vofs. The signal voltage Vsig is the voltage of a video signal representing luminance information. The video signal is a signal generated by a signal supplying source which is shown in none of the figures. In the following description, the voltage of a video signal representing luminance information is referred to simply as the signal voltage Vsig. The reference electric potential Vofs is an electric potential which serves as the reference of the signal voltage Vsig. Typically, the reference electric potential Vofs is an electric potential which corresponds to the black level of the video signal.

The signal outputting circuit 60 properly selects the voltage Vsig of a video signal representing luminance information received from a signal source not shown in FIG. 1 or a reference electric potential Vofs and writes the selected one into the pixel circuits 20 employed in the pixel matrix section 30 typically in row units through the signal lines 33-1 to **33-*n*. That is, the signal outputting circuit 60 adopts a driving method of a line-by-line sequential writing operation for writing the video-signal voltage Vsig into pixel circuits 20 in a state of being enabled to receive the video-signal voltage Vsig in row units. This is because the pixel circuits 20** are put in a state of being enabled to receive the video-signal voltage Vsig in row units as explained before.

Pixel Circuits

Figure 2:
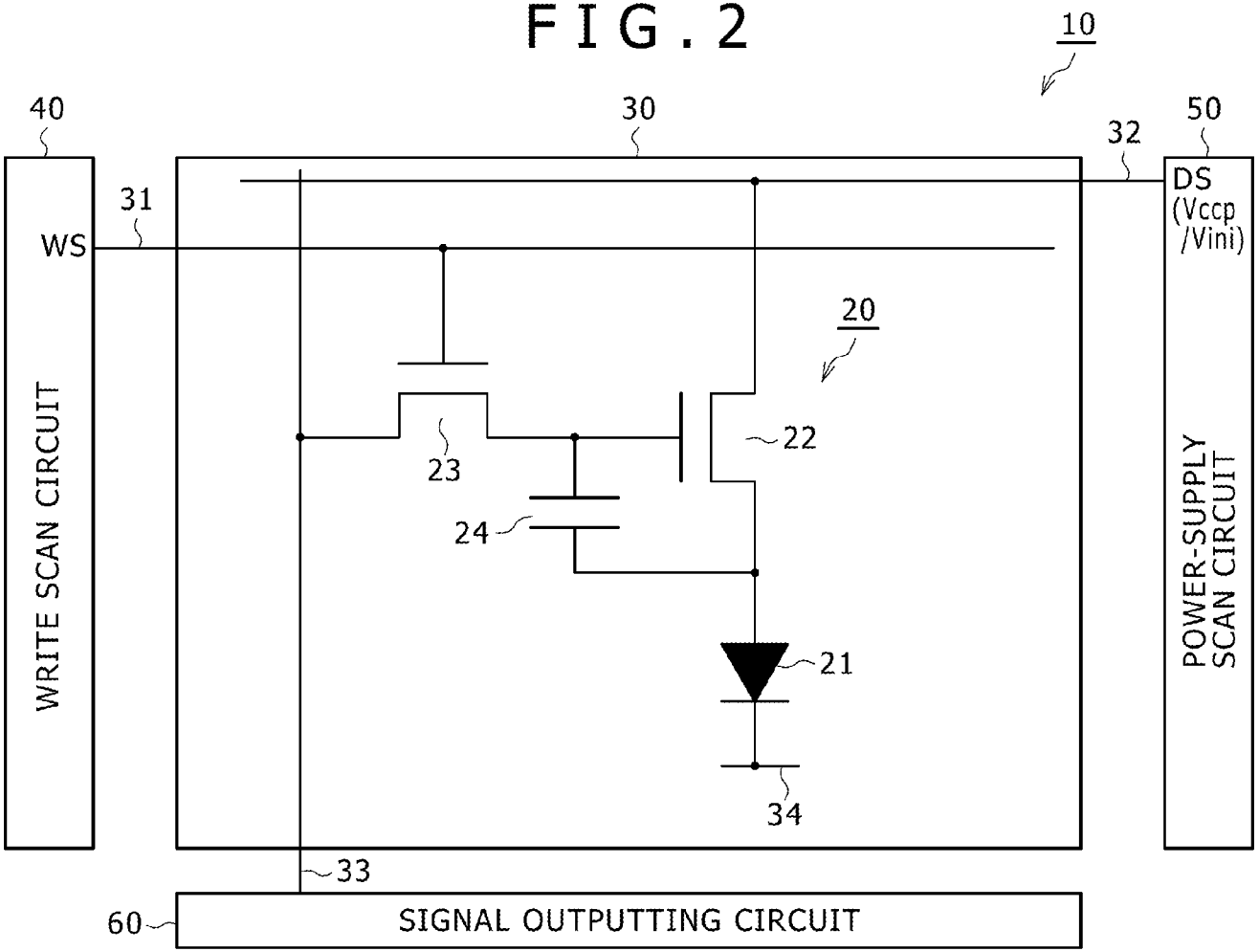
FIG. 2 is a circuit diagram showing the configuration of a pixel (or a pixel circuit) employed in the organic EL display apparatus according to the embodiments of the present invention.

FIG. 2 is a diagram showing a concrete typical configuration of the pixel circuit 20.

As shown in FIG. 2, the pixel circuit 20 includes an organic EL device 21 serving as an electro optical device (or a current-driven light emitting device) which changes the luminance of light generated thereby in accordance with the magnitude of a current flowing through the device. The pixel circuit 20 also has a driving circuit for driving the organic EL device 21. The cathode electrode of the organic EL device 21 is connected to a common power-supply line 34 shared by all pixel circuits 20. The common power-supply line 34 is also referred to as the so-called beta line.

As described above, in addition to the organic EL device 21, the pixel circuit 20 also has the driving circuit composed of driving components including the device driving transistor 22 mentioned above, the signal writing transistor 23 and the signal storage capacitor 24. In the typical configuration of the pixel circuit 20, each of the device driving transistor 22 and the signal writing transistor 23 is an N-channel TFT. However, conduction types of the device driving transistor 22 and the signal writing transistor 23 are by no means limited to the N-channel conduction type. That is, the conduction types of the device driving transistor 22 and the signal writing transistor 23 can each be another conduction type or can be conduction types different from each other.

It is to be noted that, if an N-channel TFT is used as each of the device driving transistor 22 and the signal writing transistor 23, an amorphous silicon (a-Si) process can be applied to the fabrication of the pixel circuit 20. By applying the amorphous silicon (a-Si) process to the fabrication of the pixel circuit 20, it is possible to reduce the cost of a substrate on which the TFTs are created and, hence, reduce the cost of the active-matrix organic EL display apparatus 10 itself. In addition, if the device driving transistor 22 and the signal writing transistor 23 have the same conduction type, the same process can be used for creating the device driving transistor 22 and the signal writing transistor 23. Thus, the same conduction type of the device driving transistor 22 and the signal writing transistor 23 contributes to the cost reduction.

One of the electrodes (that is, either the source or drain electrode) of the device driving transistor 22 is connected to the anode electrode of the organic EL device 21 whereas the other electrode (that is, either the drain or source electrode) of the device driving transistor 22 is connected to the power-supply line 32, that is, one of the power-supply lines 32-1 to **32-*m***.

The gate electrode of the signal writing transistor 23 is connected to the scan line 31, that is, one of the scan lines 31-1 to **31-*m*. One of the electrodes (that is, either the source or drain electrode) of the signal writing transistor 23 is connected to the signal line 33, that is, one of the signal lines 33-1 to 33-*n*, whereas the other electrode (that is, either the drain or source electrode) of the signal writing transistor 23 is connected to the gate electrode of the device driving transistor 22**.

In the device driving transistor 22 and the signal writing transistor 23, one of the electrodes is a metallic wire connected to the source or drain area of the transistor whereas the other electrode is a metallic wire connected to the drain or source area of the transistor. In addition, in accordance with a relation between an electric potential appearing on one of the electrodes and an electric potential appearing on the other electrode, one of the electrodes becomes a source or drain electrode whereas the other electrode becomes the drain or source electrode.

One of the terminals of the signal storage capacitor 24 is connected to the gate electrode of the device driving transistor 22 whereas the other terminal of the signal storage capacitor 24 is connected to one of the electrodes of the device driving transistor 22 and the anode electrode of the organic EL device 21.

It is to be noted that the configuration of the driving circuit for driving the organic EL device 21 is by no means limited to the configuration employing the device driving transistor 22, the signal writing transistor 23 and the signal storage capacitor 24 as described above. For example, if necessary, the driving circuit may include a supplementary capacitor having a capacitance for compensating the organic EL device 21 for an insufficiency of the capacitance of the organic EL device 21. One of the terminals of the supplementary capacitor is connected to the anode electrode of the organic EL device 21 whereas the other terminal of the supplementary capacitor is connected to the cathode electrode of the organic EL device 21. As described above, the cathode electrode of the organic EL device 21 is connected to the common power-supply line 34 which is set at a fixed electric potential.

In the pixel circuit 20 having the configuration described above, the signal writing transistor 23 is put in a conductive state by a high-level scan signal WS applied by the write scan circuit 40 to the gate electrode of the signal writing transistor 23 through the scan line 31, that is, one of the scan lines 31-1 to **31-*m*. In this conductive state of the signal writing transistor 23, the signal writing transistor 23 samples the video-signal voltage Vsig supplied by the signal outputting circuit 60 through the signal line 33 (that is, one of the signal lines 33-1 to 33-*n*) as a voltage having a magnitude representing luminance information, or samples the reference electric potential Vofs also supplied by the signal outputting circuit 60 through the signal line 33 and writes the sampled video-signal voltage Vsig or the sampled reference electric potential Vofs into the signal storage capacitor 24 employed in the pixel circuit 20. The sampled video-signal voltage Vsig or the sampled reference electric potential Vofs is applied to the gate electrode of the device driving transistor 22 and held in the signal storage capacitor 24**.

With the first power-supply electric potential Vccp asserted on the power-supply line 32 (that is, one of the power-supply lines 32-1 to **32-*m*) as the electric potential DS, a specific one of the electrodes of the device driving transistor 22 becomes the drain electrode whereas the other one of the electrode of the device driving transistor 22 becomes the source electrode. In the electrodes of the device driving transistor 22 functioning in this way, the device driving transistor 22 is operating in a saturated region and letting a current received from the power-supply line 32 flow to the organic EL device 21 as a driving current for driving the organic EL device 21 into a state of emitting light. To put it more concretely, the device driving transistor 22 is operating in a saturated region to supply a driving current serving as a light emission current having a magnitude according to the magnitude of the video-signal voltage Vsig stored in the signal storage capacitor 24 to the organic EL device 21. The organic EL device 21** thus emits light with a luminance according to the magnitude of the driving current in a light emission state.

When the first power-supply electric potential Vccp asserted on the power-supply line 32 (that is, one of the power-supply lines 32-1 to **32-*m*) as the electric potential DS is changed to the second power-supply electric potential Vini, the device driving transistor 22 operates as a switching transistor. When operating as a switching transistor, the specific electrode of the device driving transistor 22 becomes the source electrode whereas the other electrode of the device driving transistor 22 becomes the drain electrode. As such a switching transistor, the device driving transistor 22 stops the operation to supply the driving current to the organic EL device 21, putting the organic EL device 21 in a no-light emission state. That is, the device driving transistor 22 also has a function of a transistor for controlling transitions between the light emission and no-light emission states of the organic EL device 21**.

The device driving transistor 22 carries out a switching operation in order to set a no-light emission period for the organic EL device 21 as the period of a no-light emission state and control a duty which is defined as a ratio of the light emission period of the organic EL device 21 to the no-light emission period of the organic EL device 21. By executing such control, it is possible to reduce the amount of blurring caused by a residual image attributed to light generated by pixel circuits throughout one frame. Thus, in particular, the quality of a moving image can be made more excellent.

Either the first power-supply electric potential Vccp or the second power-supply electric potential *Vini* is selectively generated by the power-supply scan circuit 50 and asserted on the power-supply line 32. The first power-supply electric potential Vccp is a power-supply electric potential for providing the device driving transistor 22 with a driving current for driving the organic EL device 21 to emit light. On the other hand, the second power-supply electric potential Vini is a power-supply electric potential serving as a reversed bias which is applied to the organic EL device 21 in order to put the organic EL device 21 in a no-light emission state. The second power-supply electric potential Vini has to be lower than the reference electric potential Vofs. For example, the second power-supply electric potential Vini is lower than (Vofs−Vth) where reference notation Vth denotes the threshold voltage of a device driving transistor 22 employed in the pixel circuit 20. It is desirable to set the second power-supply electric potential Vini at an electric potential sufficiently lower than (Vofs−Vth).

Pixel Structure

Figure 3:
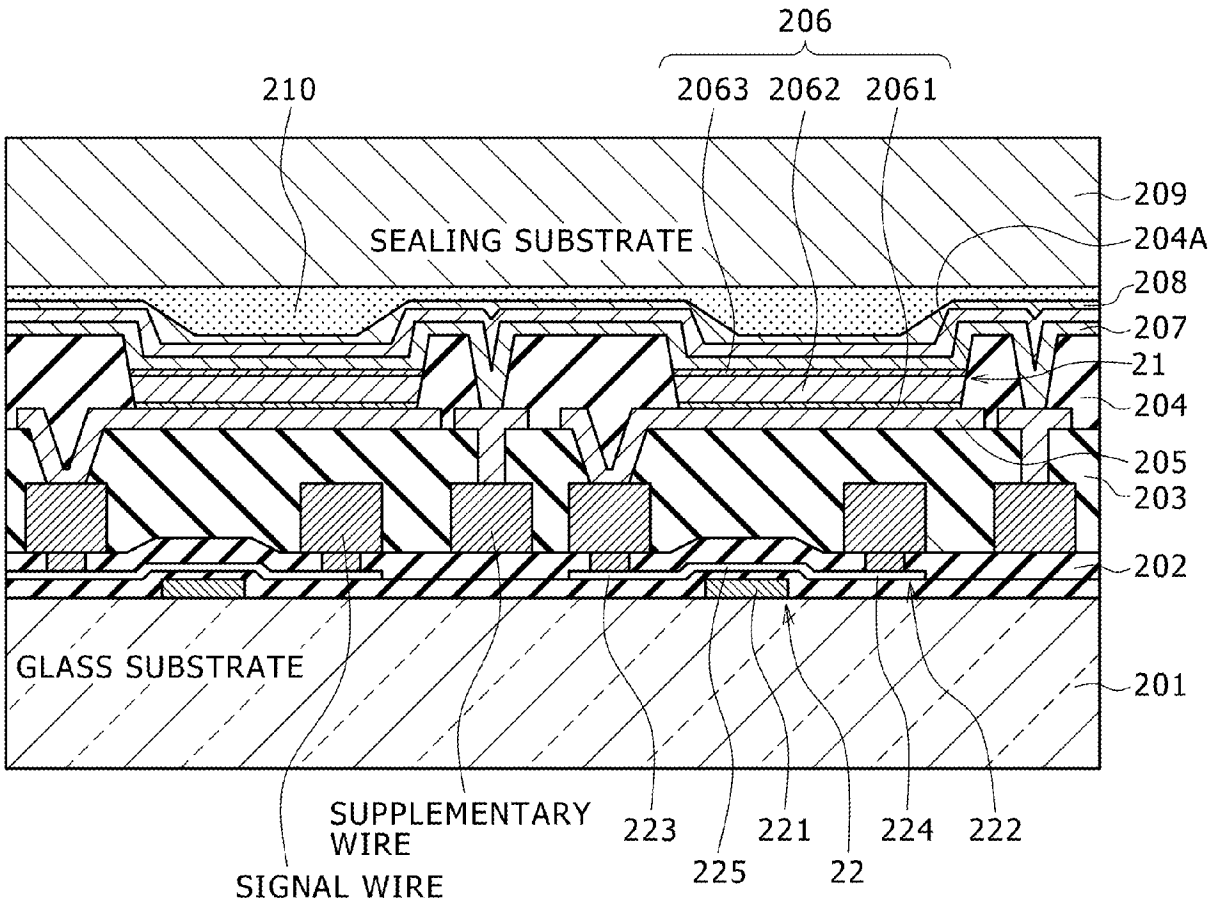
FIG. 3 is a cross-sectional diagram showing the cross section of a typical structure of the pixel circuit.

FIG. 3 is a cross-sectional diagram showing the cross section of a typical structure of the pixel circuit 20. As shown in FIG. 3, the structure of the pixel circuit 20 includes a glass substrate 201 over which driving components including the device driving transistor 22 are created. In addition, the structure of the pixel circuit 20 also includes an insulation film 202, an insulation flat film 203 and a window insulation film 204, which are sequentially created on the glass substrate 201 in an order the insulation film 202, the insulation flat film 203 and the window insulation film 204 are enumerated in this sentence. In this structure, the organic EL device 21 is provided on a dent 204A of the window insulation film 204. FIG. 3 shows merely the device driving transistor 22 of the driving circuit as a configuration element, omitting the other driving components of the driving circuit.

The organic EL device 21 has a configuration including an anode electrode 205, organic layers 206 and a cathode electrode 207. The anode electrode 205 is typically a metal created on the bottom of the dent 204A of the window insulation film 204. The organic layers 206 are an electron transport layer, a light emission layer and a hole transport/injection layer, which are created over the anode electrode 205. Placed on the organic layers 206, the cathode electrode 207 is typically a transparent conductive film created as a film common to all pixel circuits 20.

The organic layers 206 included in the organic EL device 21 are created by sequentially stacking a hole transport layer/hole injection layer 2061, a light emitting layer 2062, an electron transport layer 2063 and an electron injection layer on the anode electrode 205. It is to be noted that the electron injection layer is not shown in FIG. 3. In an operation carried out by the device driving transistor 22 to drive the organic EL device 21 to emit light by letting a current flow to the organic EL device 21 as shown in FIG. 2, the current flows from the device driving transistor 22 to the organic layers 206 by way of the anode electrode 205. With the current flowing to the organic layers 206, holes and electrons are recombined with each other in the light emitting layer 2062, causing light to be emitted.

The device driving transistor 22 is created to have a configuration including a gate electrode 221, a semiconductor layer 222, a source/drain area 223, a drain/source area 224 and a channel creation area 225. In this configuration, the source/drain area 223 is created on one of the sides of the semiconductor layer 222 whereas the drain/source area 224 is created on the other side of the semiconductor layer 222 and the channel creation area 225 faces the gate electrode 221 of the semiconductor layer 222. The source/drain area 223 is electrically connected to the anode electrode 205 of the organic EL device 21 through a contact hole.

As shown in FIG. 3, for every pixel circuit 20, an organic EL device 21 is created over the glass substrate 201, sandwiching the insulation film 202, the insulation flat film 203 and the window insulation film 204 between the organic EL device 21 and the glass substrate 201 on which the driving components including the device driving transistor 22 are formed. After organic EL devices 21 are created in this way, a passivation film 208 is created over the organic EL devices 21 and covered by a sealing substrate 209, sandwiching an adhesive 210 between the sealing substrate 209 and the passivation film 208. In this way, the organic EL devices 21 are sealed by the sealing substrate 209, forming a display panel 70.

Circuit Operations

Subsequently, by referring to a timing/waveform diagram of FIG. 4 as a base as well as circuit diagrams of FIGS. 5 and 6, the following description explains basic circuit operations carried out by the organic EL display apparatus 10. It is to be noted that, in the circuit-operation explanatory diagrams of FIGS. 5 and 6, the signal writing transistor 23 is shown as a symbol, which represents a switch, in order to make the diagrams simple. In addition, a capacitor 25 is shown in each of the circuit-operation explanatory diagrams of FIGS. 5 and 6 to serve as an equivalent capacitor of the organic EL device 21.

Figure 4:
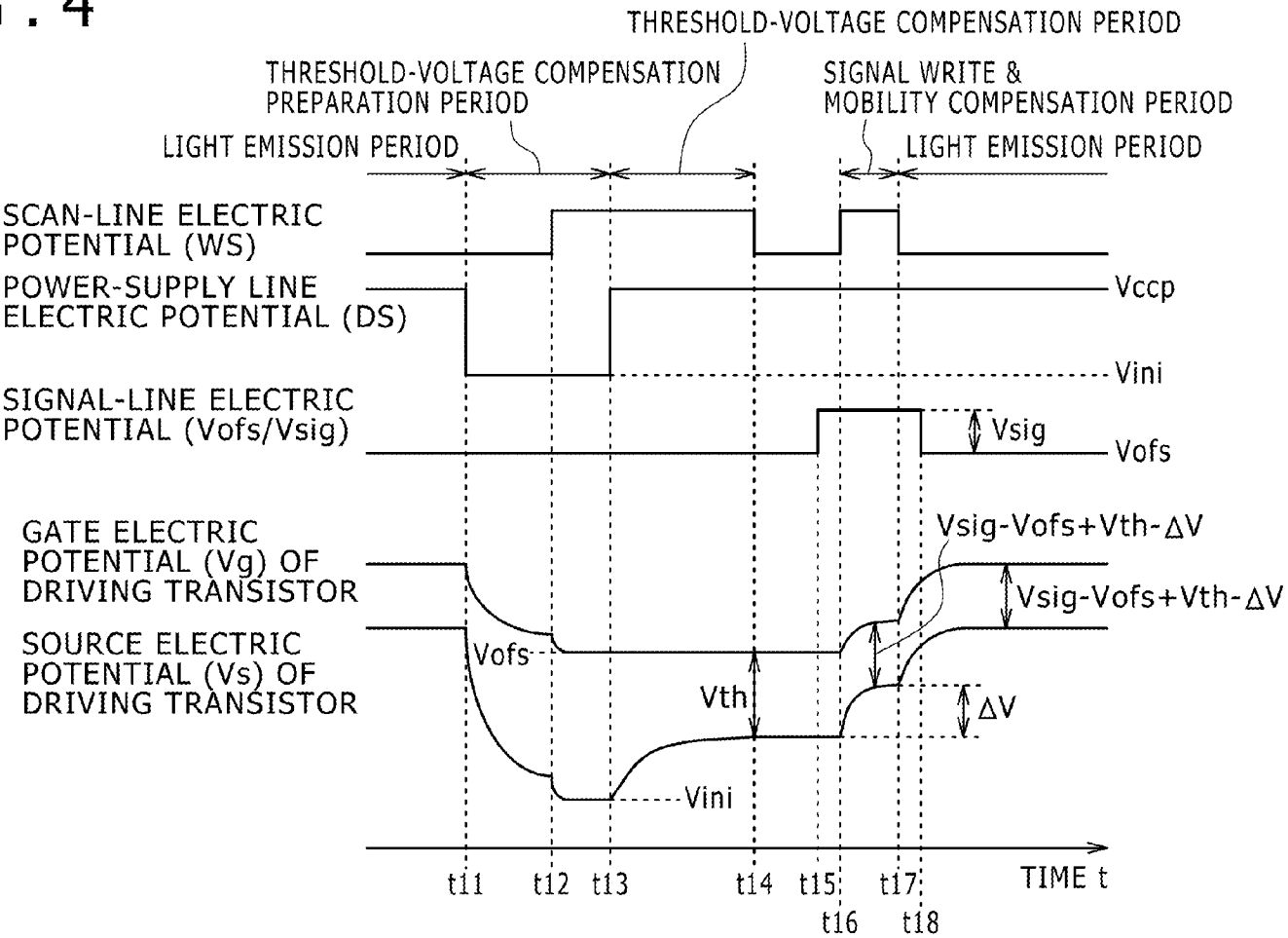
FIG. 4 is a timing/waveform diagram to be referred to in explanation of basic circuit operations carried out by the organic EL display apparatus according to the embodiments of the present invention.

The timing/waveform diagram of FIG. 4 shows variations of an electric potential (a write scan signal) WS appearing on the scan line 31, an electric potential (power-supply electric potential) DS appearing on the power-supply line 32, an electric potential (Vsig/Vofs) appearing on the signal line 33, a gate electric potential Vg appearing on the gate electrode of the device driving transistor 22, and a source electric potential Vs appearing on the source electrode of the device driving transistor 22.

Light Emission Period of the Preceding Frame

In the timing/waveform diagram of FIG. 4, a period prior to a time t11 is a light emission period of the organic EL device 21 in a frame (or a field) immediately preceding the present frame (or the present field). In a light emission period, the electric potential DS appearing on the power-supply line 32 is the first power-supply electric potential Vccp also referred to hereafter as a high electric potential and the signal writing transistor 23 is in a non-conductive state.

Figure 5A:
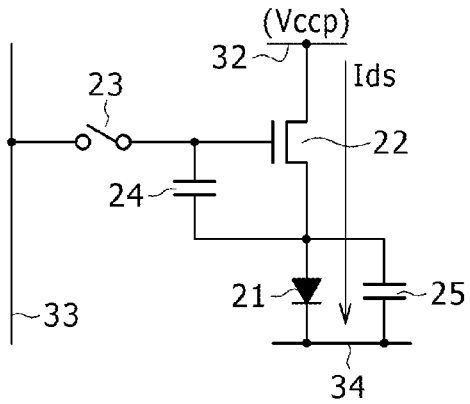
FIGS. 5A to 5D are a plurality of first circuit diagrams to be referred to in explanation of basic circuit operations carried out by the organic EL display apparatus according to the embodiments of the present invention.

With the first power-supply electric potential Vccp asserted on the power-supply line 32 and applied to the device driving transistor 22, the device driving transistor 22 is set to operate in a saturated region. Thus, in the light emission period, a driving current (that is, a light emission current or a drain-source current Ids flowing between the drain and source electrodes of the device driving transistor 22) according to the gate-source voltage Vgs applied between the gate and source electrodes of the device driving transistor 22 flows from the power-supply line 32 to the organic EL device 21 by way of the device driving transistor 22 as shown in FIG. 5A. As a result, the organic EL device 21 emits light having a luminance proportional to the magnitude of the driving current Ids.

Threshold-Voltage Compensation Preparation Period

Figure 5B:
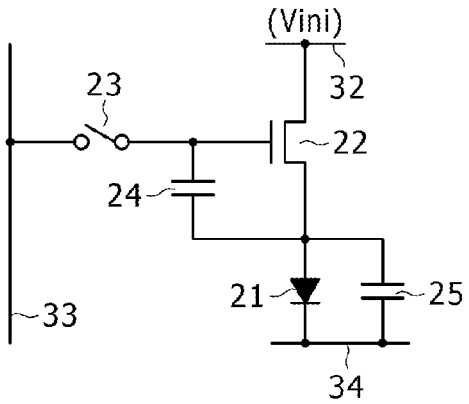

Then, at the time t11, a new frame (referred to as the aforementioned present frame) of the line-by-line sequential scan operation arrives. As shown in FIG. 5B, the electric potential DS appearing on the power-supply line 32 is changed from the high electric potential Vccp to the second power-supply electric potential Vini in order to start a threshold-voltage compensation preparation period. Also referred to hereafter as a low electric potential, typically, the low electric potential Vini is sufficiently lower than (Vofs−Vth) which is lower than Vofs where reference notation Vth denotes the threshold voltage of the device driving transistor 22 whereas reference notation Vofs denotes the aforementioned reference electric potential Vofs appearing on the signal line 33.

Let us assume that the low electric potential Vini satisfies the relation Vini<(Vthel+Vcath) where reference notation Vthel denotes the threshold voltage of the organic EL device 21 whereas reference notation Vcath denotes an electric potential appearing on the common power-supply line 34. In this case, since a source electric potential Vs appearing on the source electrode of the device driving transistor 22 is about equal to the low electric potential Vini, the organic EL device 21 is put in a reversed-bias state, ceasing to emit light.

Figure 5C:
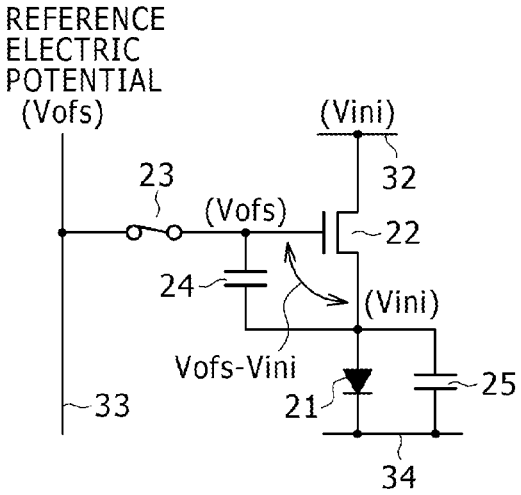

Then, at a later time t12, the electric potential WS appearing on the scan line 31 is changed from a low level to a high level, putting the signal writing transistor 23 in a conductive state to start a threshold-voltage compensation preparation period as shown in FIG. 5C. In this state, the signal outputting circuit 60 is asserting the reference electric potential Vofs on the signal line 33 and the reference electric potential Vofs is applied to the gate electrode of the device driving transistor 22 as the gate electric potential Vg by way of the signal writing transistor 23. As described above, the low electric potential Vini sufficiently lower than the reference electric potential Vofs is being supplied to the source electrode of the device driving transistor 22 as the source electric potential Vs at that time.

Thus, at that time, the gate-source voltage Vgs applied between the gate and source electrodes of the device driving transistor 22 is equal to an electric-potential difference of (Vofs−Vini). If the electric-potential difference of (Vofs−Vini) is not greater than the threshold voltage Vth of the device driving transistor 22, the threshold-voltage compensation process to be described later may not be carried out. It is thus necessary to set the low electric potential Vini and the reference electric potential Vofs at levels that satisfy the electric-potential relation (Vofs−Vini)>Vth.

The initialization process to fix (set) the electric potential Vg appearing on the gate electrode of the device driving transistor 22 at the reference electric potential Vofs and the electric potential Vs appearing on the source electrode of device driving transistor 22 at the low electric potential Vini is a process of preparation for the threshold-voltage compensation process to be described later. In the following description, the process of preparation for the threshold-voltage compensation process is referred to as a threshold-voltage compensation preparation process. In this process, the reference electric potential Vofs is an initialization electric potential of the electric potential Vg appearing on the gate electrode of the device driving transistor 22 whereas the low electric potential Vini is an initialization electric potential of the electric potential Vs appearing on the source electrode of the device driving transistor 22.

Threshold-Voltage Compensation Period

Figure 5D:
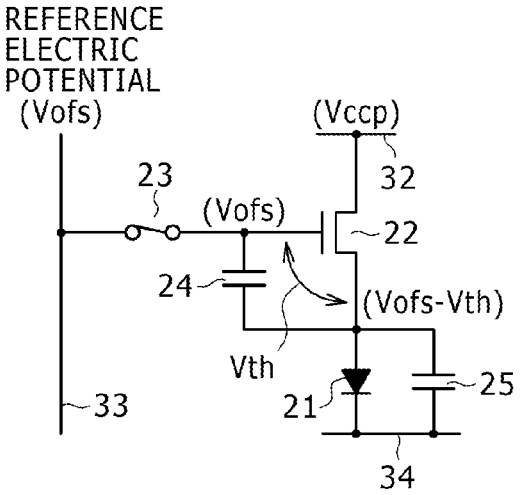

Then, when the electric potential DS appearing on the power-supply line 32 is changed from the low electric potential Vini to the high electric potential Vccp at a later time t13 as shown in FIG. 5D, in a state of sustaining the electric potential Vg appearing on the gate electrode of the device driving transistor 22 as it is, the threshold-voltage compensation period is started. That is, the electric potential Vs appearing on the source electrode of the device driving transistor 22 starts to rise toward an electric potential obtained as result of subtracting the threshold voltage Vth of the device driving transistor 22 from the gate electric potential Vg.

For the sake of convenience, the reference electric potential Vofs serving as an initialization electric potential of the electric potential Vg appearing on the gate electrode of the device driving transistor 22 as described above is taken as a reference electric potential and the process of raising the electric potential Vs to the electric potential obtained as result of subtracting the threshold voltage Vth of the device driving transistor 22 from the gate electric potential Vg is referred to as a threshold-voltage compensation process. As the threshold-voltage compensation process is going on, in due course of time, the voltage Vgs applied between the gate and source electrodes of the device driving transistor 22 is converged to the threshold voltage Vth of the device driving transistor 22, causing a voltage corresponding to the threshold voltage Vth to be stored in the signal storage capacitor 24.

It is to be noted that, in order to let the entire driving current flow to the signal storage capacitor 24 instead of flowing partially to the organic EL device 21 during the threshold-voltage compensation period in which the threshold-voltage compensation process is being carried out, the common power-supply line 34 is set at the electric potential Vcath in advance so as to put the organic EL device 21 in a cut-off state.

Figure 6A:
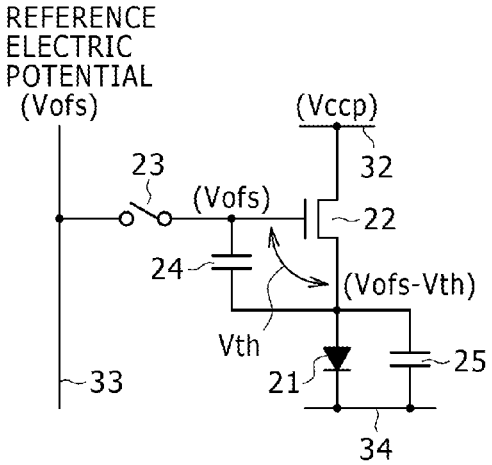
FIGS. 6A to 6D are a plurality of second circuit diagrams to be referred to in explanation of basic circuit operations carried out by the organic EL display apparatus according to the embodiments of the present invention.

Then, at a later time t14 coinciding with the end of threshold-voltage compensation period, the electric potential WS appearing on the scan line 31 is changed to a low level in order to put the signal writing transistor 23 in a non-conductive state as shown in FIG. 6A. In this non-conductive state of the signal writing transistor 23, the gate electrode of the device driving transistor 22 is electrically disconnected from the signal line 33, entering a floating state. Since the voltage Vgs appearing between the gate and source electrodes of the device driving transistor 22 is equal to the threshold voltage Vth of the device driving transistor 22, however, the device driving transistor 22 is put in a cut-off state. Thus, the drain-source current Ids does not flow through the device driving transistor 22.

Signal Write and Mobility Compensation Period

Figure 6B:
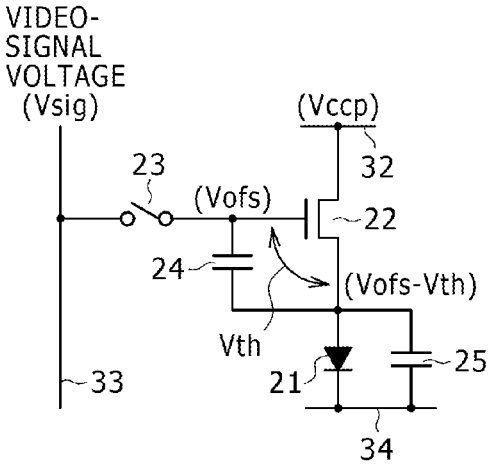
Figure 6C:
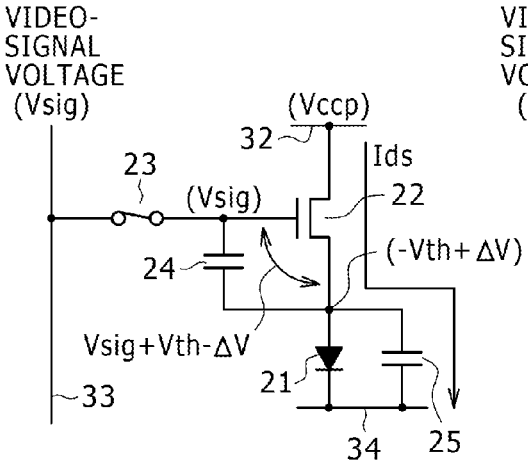

Then, at a later time t15, the electric potential appearing on the signal line 33 is changed from the reference electric potential Vofs to the video-signal voltage Vsig as shown in FIG. 6B. Subsequently, at a later time t16 coinciding with the start of the signal write and mobility compensation period, by setting the electric potential WS appearing on the scan line 31 at a high level, the signal writing transistor 23 is put in a conductive state as shown in FIG. 6C. In this state, the signal writing transistor 23 samples the video-signal voltage Vsig and stores the sampled video-signal voltage Vsig into the pixel circuit 20.

As a result of the operation carried out by the signal writing transistor 23 to store the sampled video-signal voltage Vsig into the pixel circuit 20, the electric potential Vg appearing on the gate electrode of the device driving transistor 22 becomes equal to the video-signal voltage Vsig. In the operation to drive the device driving transistor 22 by making use of the video-signal voltage Vsig, the threshold voltage Vth of the device driving transistor 22 and a voltage stored in the signal storage capacitor 24 as a voltage corresponding to the threshold voltage Vth kill each other in the so-called threshold-voltage compensation process, the principle of which will be described later in detail.

At that time, the organic EL device 21 is initially in a cut-off state (or a high-impedance state). Thus, the drain-source current Ids flowing from the power-supply line 32 to the device driving transistor 22 driven by the video-signal voltage Vsig actually goes to the aforementioned equivalent capacitor 25 connected in parallel to the organic EL device 21 instead of entering the organic EL device 21 itself. As a result, an electric charging process of the equivalent capacitor 25 is started.

While the equivalent capacitor 25 is being electrically charged, the electric potential Vs appearing on the source electrode of the device driving transistor 22 rises with the lapse of time. Since the drain-source current Ids flowing between the drain and source electrodes of the device driving transistor 22 has already been compensated for the Vth (threshold-voltage) variations from pixel to pixel, the drain-source current Ids varies from pixel to pixel merely in accordance with the mobility μ of the device driving transistor 22. The mobility μ of the driving transistor 22 is the mobility μ of the semiconductor thin film composing the channel of the driving transistor 22.

Let us assume that the write gain has an ideal value of 1. The write gain is defined as a ratio of the voltage Vgs, which is observed between the gain and source electrodes of the device driving transistor 22 and stored in the signal storage capacitor 24 as a voltage corresponding to the threshold voltage Vth of the device driving transistor 22 as described above, to the video-signal voltage Vsig. As the electric potential Vs appearing on the source electrode of the device driving transistor 22 reaches an electric potential of (Vofs−Vth+ΔV), the voltage Vgs observed between the gain and source electrodes of the device driving transistor 22 becomes equal to an electric potential of (Vsig−Vofs+Vth−ΔV) where reference notation ΔV denotes the increase in source electric potential Vs.

That is, a negative feedback operation is carried out so as to subtract the increase ΔV of the electric potential Vs appearing on the source electrode of the device driving transistor 22 from a voltage stored in the signal storage capacitor 24 as a voltage of (Vsig−Vofs+Vth) or, in other words, a negative feedback operation is carried out so as to electrically discharge some electric charge from the signal storage capacitor 24. In the negative feedback operation, the increase ΔV of the electric potential Vs appearing on the source electrode of the device driving transistor 22 is used as a negative-feedback quantity.

As described above, by negatively feeding the drain-source current Ids flowing between the drain and source electrodes of the device driving transistor 22 back to the gate input of the device driving transistor 22, that is, by negatively feeding the drain-source current Ids flowing between the drain and source electrodes of the device driving transistor 22 back to the voltage Vgs appearing between the gain and source electrodes of the device driving transistor 22, the dependence of the drain-source current Ids on the mobility μ of the device driving transistor 22 can be eliminated. That is, in the operation to sample the video-signal voltage Vsig and store the sampled video-signal voltage Vsig into the pixel circuit 20, a mobility compensation process is also carried out as well at the same time in order to compensate the drain-source current Ids flowing between the drain and source electrodes of the device driving transistor 22 for mobility (μ) variations from pixel to pixel.

To put it more concretely, the larger the amplitude Vin (=Vsig−Vofs) of the video-signal voltage Vsig to be stored in the gate electrode of the device driving transistor 22, the bigger the drain-source current Ids flowing between the drain and source electrodes of the device driving transistor 22 and, hence, the larger the absolute value of the increase ΔV used as the negative-feedback quantity (or the compensation quantity) of the negative feedback operation. Thus, it is possible to carry out a mobility compensation process according to the level of the luminance of light emitted by the organic EL device 21.

For a fixed amplitude Vin of the video-signal voltage Vsig, the larger the mobility μ of the device driving transistor 22, the bigger the absolute value of the increase ΔV used as the negative-feedback quantity (or the compensation quantity) of the negative feedback operation. It is thus possible to compensate the drain-source current Ids flowing between the drain and source electrodes of the device driving transistor 22 for mobility (μ) variations from pixel to pixel. The principle of the mobility compensation process will be described later in detail.

Light Emission Period

Figure 6D:
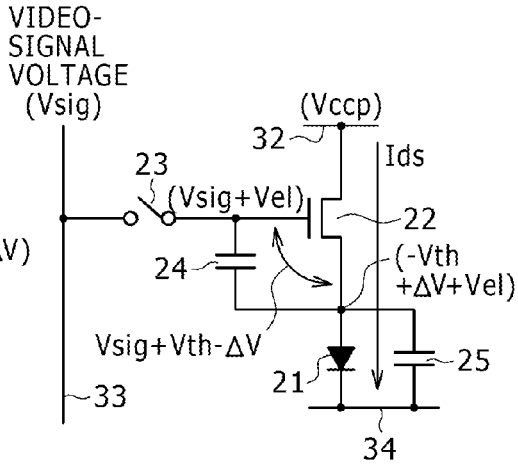

Then, at a later time t7 coinciding with the end of the signal write and mobility compensation period or the start of a light emission period, the electric potential WS appearing on the scan line 31 is changed to a low level in order to put the signal writing transistor 23 in a non-conductive state as shown in FIG. 6D. With the electric potential WS put at a low level, the gate electrode of the device driving transistor 22 is electrically disconnected from the signal line 33, entering a floating state.

With the gate electrode of the device driving transistor 22 put in a floating state and with the gate as well as source electrodes of the device driving transistor 22 connected to the signal storage capacitor 24, when the electric potential Vs appearing on the source electrode of the device driving transistor 22 varies in accordance with the amount of electrical charge stored in the signal storage capacitor 24, the electric potential Vg appearing on the gate electrode of the device driving transistor 22 also varies in a manner of being interlocked with the variation of the electric potential Vs. The operation in which the electric potential Vg appearing on the gate electrode of the device driving transistor 22 also varies in a manner of being interlocked with the variation of the electric potential Vs appearing on the source electrode of the device driving transistor 22 is referred to as a bootstrap operation which is based on a coupling effect provided by the signal storage capacitor 24.

At the time the gate electrode of the device driving transistor 22 is put in a floating state, the drain-source current Ids flowing between the drain and source electrodes of the device driving transistor 22 starts to flow to the organic EL device 21. Thus, an electric potential appearing on the anode electrode of the organic EL device 21 rises in accordance with an increase in drain-source current Ids.

As the electric potential appearing on the anode electrode of the organic EL device 21 exceeds an electric potential of (Vthel+Vcath), a driving current (or a light emission current) starts to flow through the organic EL device 21, causing the organic EL device 21 to begin emitting light. The increase of the electric potential appearing on the anode electrode of the organic EL device 21 is no other than the increase of the electric potential Vs appearing on the source electrode of the device driving transistor 22. When of the electric potential Vs appearing on the source electrode of the device driving transistor 22 rises, in the bootstrap operation based on the coupling effect provided by the signal storage capacitor 24, the electric potential Vg appearing on the gate electrode of the device driving transistor 22 also rises in a manner of being interlocked with the variation of the electric potential Vs appearing on the source electrode of the device driving transistor 22.

Let us assume that a bootstrap gain of the bootstrap operation has an ideal value of 1. The bootstrap gain of the bootstrap operation is defined as the ratio of the increase of the electric potential Vg appearing on the gate electrode of the device driving transistor 22 to the increase of the electric potential Vs appearing on the source electrode of the device driving transistor 22. With the bootstrap gain of the bootstrap operation assumed to have an ideal value of 1, the increase of the electric potential Vg appearing on the gate electrode of the device driving transistor 22 is equal to the increase of the electric potential Vs appearing on the source electrode of the device driving transistor 22. Therefore, during a light emission period, the gate-source voltage Vgs applied between the gate and source electrodes of the device driving transistor 22 is sustained at a fixed level of (Vsig−Vofs+Vth−ΔV). Then, at a later time t18, the video-signal voltage Vsig asserted on the signal line 33 is changed to the reference electric potential Vofs.

In the series of operations described above, various kinds of processing including the threshold-voltage compensation preparation process, the threshold-voltage compensation process, the signal writing operation to store the video-signal voltage Vsig into the signal storage capacitor 24 and the mobility compensation process are carried out in one horizontal scan period referred to as 1H. The signal writing operation to store the video-signal voltage Vsig into the signal storage capacitor 24 and the mobility compensation process are carried out concurrently at the same time during a period between the times t6 and t7.

As exemplified above, a driving method for carrying out the threshold compensation processing once is adopted as an example. It is to be noted, however, that this driving method is no more than a typical driving method. That is to say, the driving method is by no means limited to the driving method for carrying out the threshold compensation processing once. For example, it is possible to adopt a driving method for carrying out the so-called split threshold compensation processing. The spilt threshold compensation processing is threshold compensation processing carried out repeatedly a plurality of times over a plurality of horizontal scan periods leading ahead of a 1-H period in which threshold compensation processing is carried out along with mobility compensation processing and signal write processing. That is to say, the spilt threshold compensation processing includes the threshold compensation processing carried out repeatedly a plurality of times over a plurality of horizontal scan periods leading ahead of the 1-H period in addition to the threshold compensation processing carried out in the 1-H period.

By adopting the driving method for carrying out the spilt threshold compensation processing, the threshold compensation processing can be carried out with a high degree of reliability. This is because a sufficiently long time period can be assured as a continuous resultant threshold compensation period stretched over a plurality of component threshold compensation periods even if the time allocated to each of the component threshold compensation periods becomes shorter due to the larger number of pixels desired for high-definition displays.

Principle of the Threshold-Voltage Compensation Process

The following description explains the principle of the threshold-voltage compensation process carried out in the threshold-voltage compensation period between the times t3 and t4, which are described earlier by referring to the timing/waveform diagram of FIG. 4, in order to compensate the drain-source current Ids flowing between the drain and source electrodes of the device driving transistor 22 for variations of the threshold voltage Vth of the device driving transistor 22 from pixel to pixel. As described before, the device driving transistor 22 is designed to operate in a saturated region with the first power-supply electric potential Vccp asserted on the power-supply line 32 and applied to the device driving transistor 22 in the threshold-voltage compensation period between the times t3 and t4. Thus, the device driving transistor 22 works as a constant-current source. As a result, the device driving transistor 22 supplies a constant drain-source current Ids (also referred to as a driving current or a light emission current) given by Eq. (1) to the organic EL device 21.

$$Ids=(1/2)\cdot\mu(W/L)Cox(Vgs-Vth)^2 \quad (1)$$

In the above equation, reference notation W denotes the width of the channel of the device driving transistor 22, reference notation L denotes the length of the channel and reference notation Cox denotes a gate capacitance per unit area.

Figure 7:
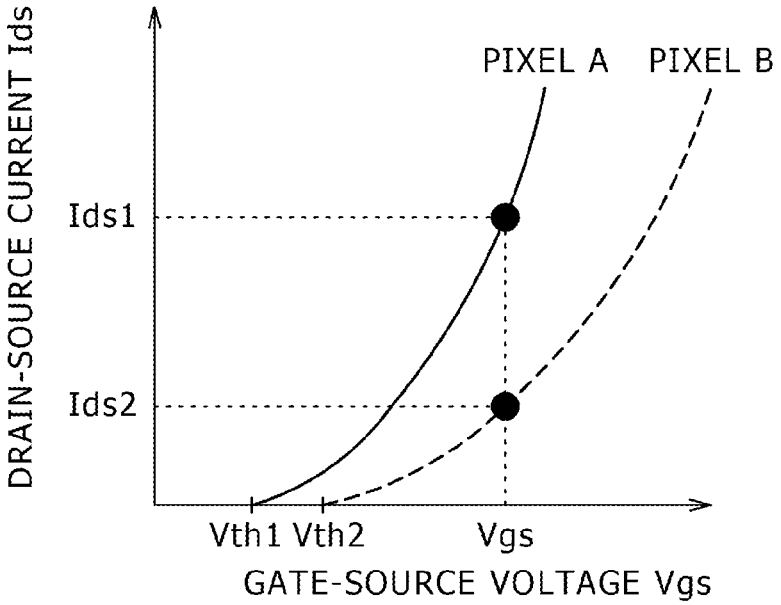
FIG. 7 is a characteristic diagram showing curves each representing a current-voltage characteristic expressing a relation between the drain-source current Ids flowing between the drain and source electrodes of a device driving transistor and the gate-source voltage Vgs applied between the gate and source electrodes of the device driving transistor as curves used for explaining variations in threshold voltage Vth from transistor to transistor.

FIG. 7 is a characteristic diagram showing curves each representing a current-voltage characteristic expressing a relation between the drain-source current Ids flowing between the drain and source electrodes of the device driving transistor 22 and the gate-source voltage Vgs applied between the gate and source electrodes of the device driving transistor 22.

A solid line in the characteristic diagram of FIG. 7 represents a characteristic for pixel circuit A having a device driving transistor 22 with a threshold voltage Vth1 whereas a dashed line in the same characteristic diagram represents a characteristic for pixel circuit B having a device driving transistor 22 with a threshold voltage Vth2 different from the threshold voltage Vth1. As is obvious from the characteristic diagram of FIG. 7, for the same magnitude of the gate-source voltage Vgs represented by the horizontal axis, the drain-source current Ids flowing between the drain and source electrodes of the device driving transistor 22 employed in pixel circuit A is Ids1 whereas the drain-source current Ids flowing between the drain and source electrodes of the device driving transistor 22 employed in pixel circuit B is Ids2 different from the drain-source current Ids1 unless a threshold-voltage compensation process is carried out to compensate the drain-source current Ids flowing between the drain and source electrodes of the device driving transistor 22 for variations in Vth from pixel to pixel where reference notation Vth denotes the threshold voltage of the device driving transistor 22.

In the example shown in the characteristic diagram of FIG. 7, the threshold voltage Vth2 of the device driving transistor 22 employed in pixel circuit B is greater than the threshold voltage Vth1 of the device driving transistor 22 employed in pixel circuit A, that is, Vth2>Vth1. In this case, for the same magnitude of the gate-source voltage Vgs represented by the horizontal axis, the drain-source current Ids flowing between the drain and source electrodes of the device driving transistor 22 employed in pixel circuit A is Ids1 whereas the drain-source current Ids flowing between the drain and source electrodes of the device driving transistor 22 employed in pixel circuit B is Ids2 which smaller than the drain-source current Ids1, that is, Ids2<Ids1. That is, even for the same magnitude of the gate-source voltage Vgs represented by the horizontal axis, if the threshold voltage Vth of the device driving transistor 22 varies from pixel to pixel, the drain-source current Ids flowing between the drain and source electrodes of the drain-source current also varies from pixel to pixel as well.

In the pixel circuit 20 having the configuration described above, on the other hand, the gate-source voltage Vgs applied between the gate and source electrodes of the device driving transistor 22 at a light emission time is equal to (Vsig−Vofs+Vth−ΔV) as described before. By substituting the expression (Vsig−Vofs+Vth−ΔV) into Eq. (1) to serve as a replacement of the term Vgs, the drain-source current Ids can be expressed by Eq. (2) as follows:

$$Ids=(1/2)\cdot\mu(W/L)Cox(Vsig-Vofs-\Delta V)^2 \quad (2)$$

That is, the term Vth representing the threshold voltage of the device driving transistor 22 disappears from the expression on the right-hand side of Eq. (2). In other words, the drain-source current Ids flowing from the device driving transistor 22 to the organic EL device 21 is no longer dependent on the threshold voltage Vth of the device driving transistor 22. As a result, even if the threshold voltage Vth of the device driving transistor 22 varies from pixel to pixel due to variations in process of manufacturing the device driving transistor 22 or due to the time degradation, the drain-source current Ids does not vary from pixel to pixel provided that the same gate-source voltage Vgs represented by the horizontal axis is applied to the gate electrodes of the device driving transistors 22 employed in the pixel circuits. Thus, it is possible to sustain the luminance of light emitted by each of organic EL devices 21 at the same value if the same gate-source voltage Vgs representing the same video-signal voltage Vsig is applied to the gate electrodes of the device driving transistors 22 employed in the pixel circuits 20 each including one of the organic EL devices 21.

Principle of the Mobility Compensation Process

Figure 8:
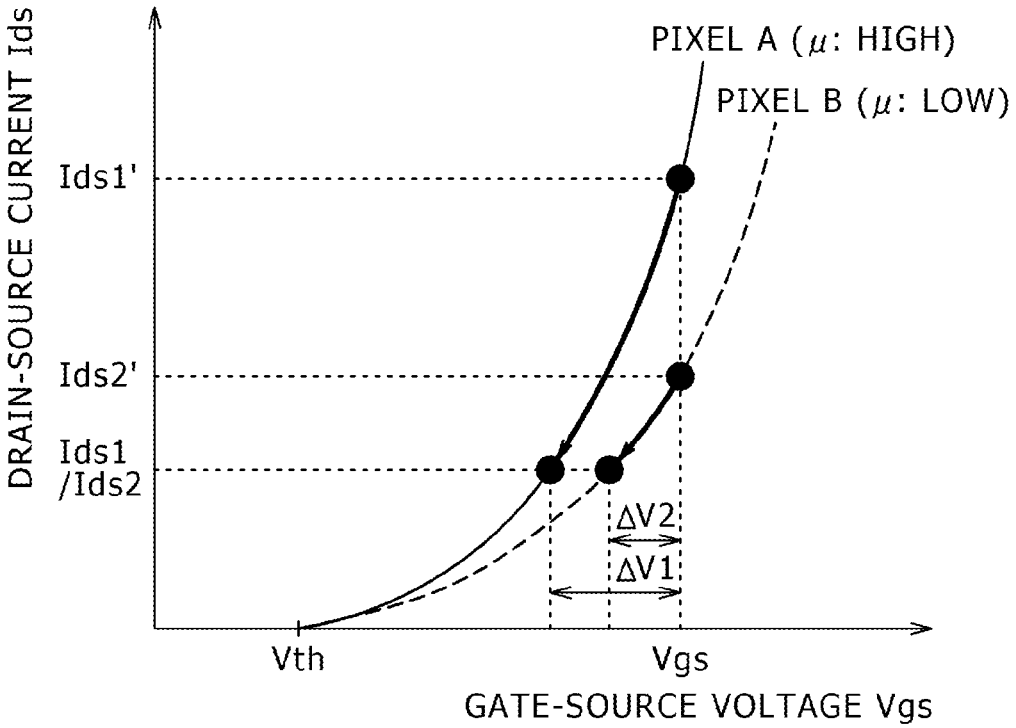
FIG. 8 is a characteristic diagram showing curves each representing a current-voltage characteristic expressing a relation between the drain-source current Ids flowing between the drain and source electrodes of a device driving transistor and the gate-source voltage Vgs applied between the gate and source electrodes of the device driving transistor as curves used for explaining variations in mobility μ from transistor to transistor.

The following description explains the principle of the mobility compensation process carried out to compensate the drain-source current Ids flowing between the drain and source electrodes of the device driving transistor 22 for variations of the mobility of the device driving transistor 22 from pixel to pixel. FIG. 8 is also a characteristic diagram showing curves each representing a current-voltage characteristic expressing a relation between the drain-source current Ids flowing between the drain and source electrodes of the device driving transistor 22 and the gate-source voltage Vgs applied between the gate and source electrodes of the device driving transistor 22. A solid line in the characteristic diagram of FIG. 8 represents a characteristic for pixel circuit A having a device driving transistor 22 with a relatively large mobility μ whereas a dashed line in the same characteristic diagram represents a characteristic for pixel circuit B having a device driving transistor 22 with a relatively small mobility μ even though the device driving transistor 22 employed in pixel circuit A has a threshold voltage Vth equal to the threshold voltage Vth of the device driving transistor 22 employed in pixel circuit A. As is obvious from FIG. 8, for the same magnitude of the gate-source voltage Vgs represented by the horizontal axis, the drain-source current Ids flowing between the drain and source electrodes of the device driving transistor 22 employed in pixel circuit A is Ids1' whereas the drain-source current Ids flowing between the drain and source electrodes of the device driving transistor 22 employed in pixel circuit B is Ids2' different from the drain-source current Ids1' unless a mobility compensation process is carried out to compensate the drain-source current Ids flowing between the drain and source electrodes of the device driving transistor 22 for the mobility variations from pixel to pixel. If a poly-silicon thin film transistor or the like is employed in the pixel circuit 20 as the device driving transistor 22, variations in mobility μ from pixel to pixel such as the differences in mobility μ between pixel circuits A and B may not be avoided.

With the existing differences in mobility μ between pixel circuits A and B, even if the same gate-source voltage Vgs representing the same video-signal voltage Vsig is applied to the gate electrodes of the device driving transistors 22 employed in pixel circuit A employing a device driving transistor 22 with a relatively large mobility μ and pixel circuit B employing a device driving transistor 22 with a relatively small mobility μ, the drain-source current Ids flowing between the drain and source electrodes of the device driving transistor 22 employed in pixel circuit A is Ids1' whereas the drain-source current Ids flowing between the drain and source electrodes of the device driving transistor 22 employed in pixel circuit B is Ids2' much different from the drain-source current Ids1' unless a mobility compensation process is carried out to compensate the drain-source current Ids flowing between the drain and source electrodes of the device driving transistor 22 for the differences in mobility μ between pixel circuits A and B. If such a large Ids difference is caused by variations in μ from pixel to pixel as a difference in drain-source current Ids between the device driving transistors 22 where reference notation μ denotes the mobility of the device driving transistor 22, the uniformity of the screen is lost.

As is obvious from Eq. (1) given earlier as an equation expressing the characteristic of the device driving transistor 22, the larger the mobility μ of a device driving transistor 22, the larger the drain-source current Ids flowing between the drain and source electrodes of the device driving transistor 22. Since the feedback quantity ΔV of the negative feedback operation is proportional to the drain-source current Ids flowing between the drain and source electrodes of the device driving transistor 22, the larger the mobility μ of a device driving transistor 22, the larger the feedback quantity ΔV of the negative feedback operation. As shown in FIG. 8, the feedback quantity ΔV1 of pixel circuit A employing a device driving transistor 22 with a relatively large mobility μ is greater than the feedback quantity ΔV2 of pixel circuit B employing a device driving transistor 22 with a relatively small mobility μ.

The mobility compensation process is carried out by negatively feeding the drain-source current Ids flowing between the drain and source electrodes of the device driving transistor 22 back to the Vsig side where reference notation Vsig denotes the voltage of the video signal. In this negative feedback operation, the larger the mobility μ of a device driving transistor 22, the higher the degree at which the negative feedback operation is carried out. As a result, it is possible to eliminate the variations in μ from pixel to pixel where reference notation μ denotes the mobility of the device driving transistor 22.

To put it concretely, if the compensation quantity ΔV1 is taken as the feedback quantity ΔV1 in the negative feedback operation of the mobility compensation process carried out on pixel circuit A employing a device driving transistor 22 with a relatively large mobility μ, the drain-source current Ids flowing between the drain and source electrodes of the device driving transistor 22 employed in pixel circuit A is greatly reduced from Ids1' to Ids1. If the compensation quantity ΔV2 smaller than the compensation quantity ΔV1 is taken as the feedback quantity ΔV2 in the negative feedback operation of the mobility compensation process carried out on pixel circuit B employing a device driving transistor 22 with a relatively small mobility μ, on the other hand, in comparison with pixel circuit A, the drain-source current Ids flowing between the drain and source electrodes of the device driving transistor 22 employed in pixel circuit B is slightly reduced from Ids2' to Ids2 which is all but equal to the drain-source current Ids1. As a result, since Ids1 representing the drain-source current Ids flowing between the drain and source electrodes of the device driving transistor 22 employed in pixel circuit A is all but equal to Ids2 representing the drain-source current Ids flowing between the drain and source electrodes of the device driving transistor 22 employed in pixel circuit B, it is possible to compensate the drain-source current Ids flowing between the drain and source electrodes of the device driving transistor 22 for the variations of the mobility of the device driving transistor 22 from pixel to pixel.

What has been described above is summarized as follows. The feedback quantity ΔV1 taken in the negative feedback operation carried out as the mobility compensation process on pixel circuit A employing a device driving transistor 22 with a relatively large mobility μ is large in comparison with the feedback quantity ΔV2 taken in the negative feedback operation of the mobility compensation process carried out on pixel circuit B employing a device driving transistor 22 with a relatively small mobility μ. That is, the larger the mobility μ of a device driving transistor 22, the larger the feedback quantity ΔV of the negative feedback operation carried out on a pixel circuit employing the device driving transistor 22 and, hence, the larger the decrease in drain-source current Ids flowing between the drain and source electrodes of the device driving transistor 22.

Thus, by negatively feeding the drain-source current Ids flowing between the drain and source electrodes of the device driving transistor 22 back to the gate-electrode side provided with the video-signal voltage Vsig as the gate-electrode side of the device driving transistor 22, the magnitudes of the drain-source currents Ids following through device driving transistors 22 employed in pixel circuits as device driving transistors 22 having different values of the mobility μ can be averaged. As a result, it is possible to compensate the drain-source current Ids flowing between the drain and source electrodes of the device driving transistor 22 for variations of the mobility of the device driving transistor 22 from pixel to pixel. That is, the negative-feedback operation of negatively feeding the magnitude of the drain-source current Ids flowing between the drain and source electrodes of the device driving transistor 22 back to the gate-electrode side of the device driving transistor 22 is the mobility compensation process.

Figure 9A:
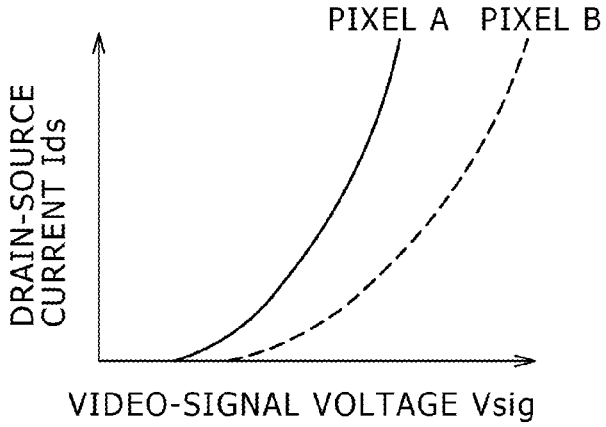
FIGS. 9A to 9C are a plurality of diagrams each showing relations between a video-signal voltage Vsig and a drain-source current Ids flowing between the drain and source electrodes of a device driving transistor for a variety of cases.
Figure 9B:
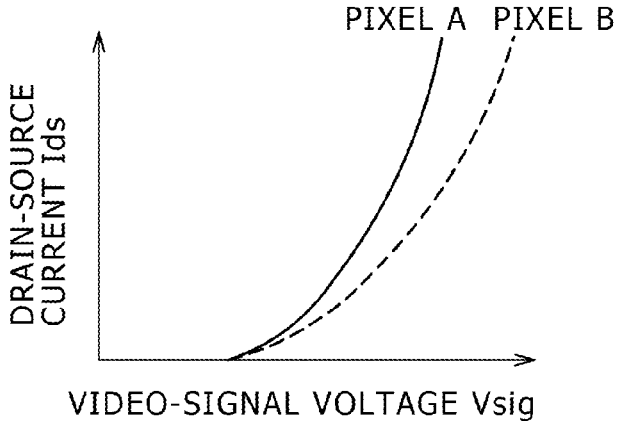
Figure 9C:
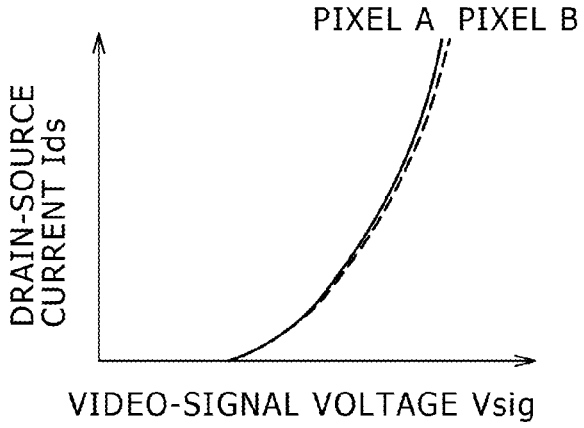

FIGS. 9A to 9C are a plurality of diagrams each showing relations between the video-signal voltage Vsig (or the sampled electric potential) and the drain-source current Ids flowing between the drain and source electrodes of the device driving transistor 22 employed in the pixel circuit 20 included in the active-matrix organic EL display apparatus 10 shown in FIG. 2. The diagrams show such relations for a variety of driving methods carried out with or without the threshold-voltage compensation process and with or without the mobility compensation process.

To be more specific, FIG. 9A is a diagram showing two curves each representing a relation between the video-signal voltage Vsig and the drain-source current Ids flowing between the drain and source electrodes of the device driving transistor 22 for respectively different pixel circuits A and B which are subjected to neither the threshold-voltage compensation process nor the mobility compensation process. FIG. 9B is a diagram showing two curves each representing a relation between the video-signal voltage Vsig and the drain-source current Ids flowing between the drain and source electrodes of the device driving transistor 22 for respectively different pixel circuits A and B which are subjected to the threshold-voltage compensation process but not subjected to the mobility compensation process. FIG. 9C is a diagram showing two curves each representing a relation between the video-signal voltage Vsig and the drain-source current Ids flowing between the drain and source electrodes of the device driving transistor 22 for respectively different pixel circuits A and B which are subjected to both the threshold-voltage compensation process and the mobility compensation process.

As shown by the curves of FIG. 9A given for a case in which pixel circuits A and B are subjected to neither the threshold-voltage compensation process nor the mobility compensation process, for the same magnitude of the gate-source voltage Vgs represented by the horizontal axis, a big difference in drain-source current Ids between pixel circuits A and B having different threshold voltages Vth and different values of the mobility μ is observed as a difference caused by the different threshold voltages Vth and the different values of the mobility μ.

As shown by the curves of FIG. 9B given for a case in which pixel circuits A and B are subjected to the threshold-voltage compensation process but not subjected to the mobility compensation process, on the other hand, for the same magnitude of the gate-source voltage Vgs represented by the horizontal axis, a smaller difference in drain-source current Ids between pixel circuits A and B having different threshold voltages Vth and different values of the mobility μ is observed as a difference caused by the different threshold voltages Vth and the different values of the mobility μ. Even though the difference is reduced to a certain degree from the difference for the case shown by the curves of FIG. 9A, the difference still remains.

As shown by the curves of FIG. 9C given for a case in which pixel circuits A and B are subjected to both the threshold-voltage compensation process and the mobility compensation process, for the same magnitude of the gate-source voltage Vgs represented by the horizontal axis, all but no difference in drain-source current Ids between pixel circuits A and B having different threshold voltages Vth and different values of the mobility μ is observed as a difference caused by the different threshold voltages Vth and the different values of the mobility μ. Thus, there are no variations of the luminance of light emitted by the organic EL device 21 from pixel to pixel for every gradation. As a result, it is possible to display an image having a high quality.

In addition, besides the threshold-voltage and mobility compensation functions, the pixel circuit 20 included in the active-matrix organic EL display apparatus 10 shown in FIG. 2 also has a bootstrap-operation function based on the coupling effect provided by the signal storage capacitor 24 as described previously so that the pixel circuit 20 is capable of exhibiting an effect described as follows.

Even if the electric potential Vs appearing on the source electrode of the device driving transistor 22 changes because the I-V characteristic of the organic EL device 21 deteriorates with the lapse of time in a time degradation process, the bootstrap operation based on the coupling effect provided by the signal storage capacitor 24 allows the gate-source voltage Vgs applied between the gate and source electrodes of the device driving transistor 22 to be sustained at a fixed level so that the driving current flowing through the organic EL device 21 also does not change with the lapse of time in a time degradation process. Thus, since the luminance of light emitted by the organic EL device 21 also does not vary with the lapse of time in a time degradation process, it is possible to display images with no deteriorations accompanying the time degradation of the I-V characteristic of the organic EL device 21 even if the I-V characteristic worsens with the lapse of time in a time degradation process.

2: Characteristics of Embodiments

In the active-matrix type organic EL display apparatus 10 having the configuration described above, each of the write scan circuit 40 and the power-supply scan circuit 50 functions as a row scan circuit. In the configuration of the row scan circuit, an enable signal for prescribing the rising and falling timings of every scan signal is supplied to the row scan circuit as an enable signal common to all reference signals generated in the row scan circuit to serve as reference signals from which all their respective scan signals are to be generated as will be described later in detail. The configuration of the row scan circuit includes a level shift circuit section which has a plurality of level shift circuits each provided for a scan line for propagating a scan signal. Each of the level shift circuits employed in the level shift circuit section provided for a plurality of scan lines is a circuit for changing the aforementioned reference signal from a first amplitude to a second amplitude. In a typical configuration shown in FIG. 10, a write scan circuit 40A is the row scan circuit whereas the level shift circuit section 46 is the level shift circuit section provided for a plurality of scan lines.

The row scan circuit also employs a logic processing section (also referred to hereafter as a logic circuit section) having a plurality of logic circuits which are each provided for one of the scan lines. In the configuration shown in FIG. 10, a second logic circuit section 48 is the logic processing section whereas each of AND gates 48-1, 48-2, 48-3 and so on employed in the second logic circuit section 48 is the logic circuit. Each of the logic circuits computes a logical product of the enable signal supplied to the logic circuit through the common transmission line and the reference signal supplied to the logic circuit through a scan line connected to the logic circuit as the reference of the scan signal in order to set the rising and falling timings of the scan signal in accordance with the enable signal. The reference of a scan signal is a reference signal from which the scan signal is generated. In addition, the logic processing section is defined in that such a logical product is computed during a time period used for generating any specific one of the reference signals to be supplied to their respective logic circuits employed in the logic processing section, and it is during the time period that an input node formed on the logic circuit provided for the specific reference signal to serve as an input node for receiving the enable signal is electrically connected to the common transmission line.

As is obvious from the above description, each of the logic circuits has an enable-signal receiving input node which is an input node for receiving the enable signal. It is during a time period used for generating any specific reference signal to be supplied to a specific logic circuit that the enable-signal receiving input node of the specific logic circuit is electrically connected to the common transmission line. Thus, the enable signal is supplied to a logic circuit synchronously with the reference signal received by the logic circuit. During the time period used for generating the specific reference signal, the logic circuit receiving the specific reference signal is the logic circuit having the enable-signal receiving input node thereof electrically connected to the common transmission line.

Thus, in comparison with a configuration in which the enable-signal receiving input node of every logic circuit is electrically connected to the common transmission line, the capacitance of a total load borne by the common transmission line is reduced to a fraction. The capacitance of the total load borne by the common transmission line includes the capacitance of a transistor composing each logic circuit electrically connected to the common transmission line. As a result, it is possible to reduce the power consumed in processes of electrically charging and discharging the enable signal into and from the common transmission line. That is to say, the power consumption of the scan section can thus be decreased. In the case of this embodiment, the scan lines are horizontal scan lines laid out in the vertical direction.

The following description explains some preferred embodiments which each concretely implement the row scan circuit. Each of the embodiments to be described below implements a write scan circuit 40 which functions as the row scan section. To put it more concretely, the embodiments to be described below are first, second and third embodiments which implement write scan circuits 40A, 40B and 40C respectively. That is to say, the write scan circuits 40A, 40B and 40C are the write scan circuit 40 according to the first, second and third embodiments respectively. It is to be noted that a power-supply scan circuit 50 is also a typical concrete implementation of the row scan circuit according to the embodiment. The power-supply scan circuit 50 can be designed to have a configuration identical with that of the write scan circuit 40.

2-1: First Embodiment

Figure 10:
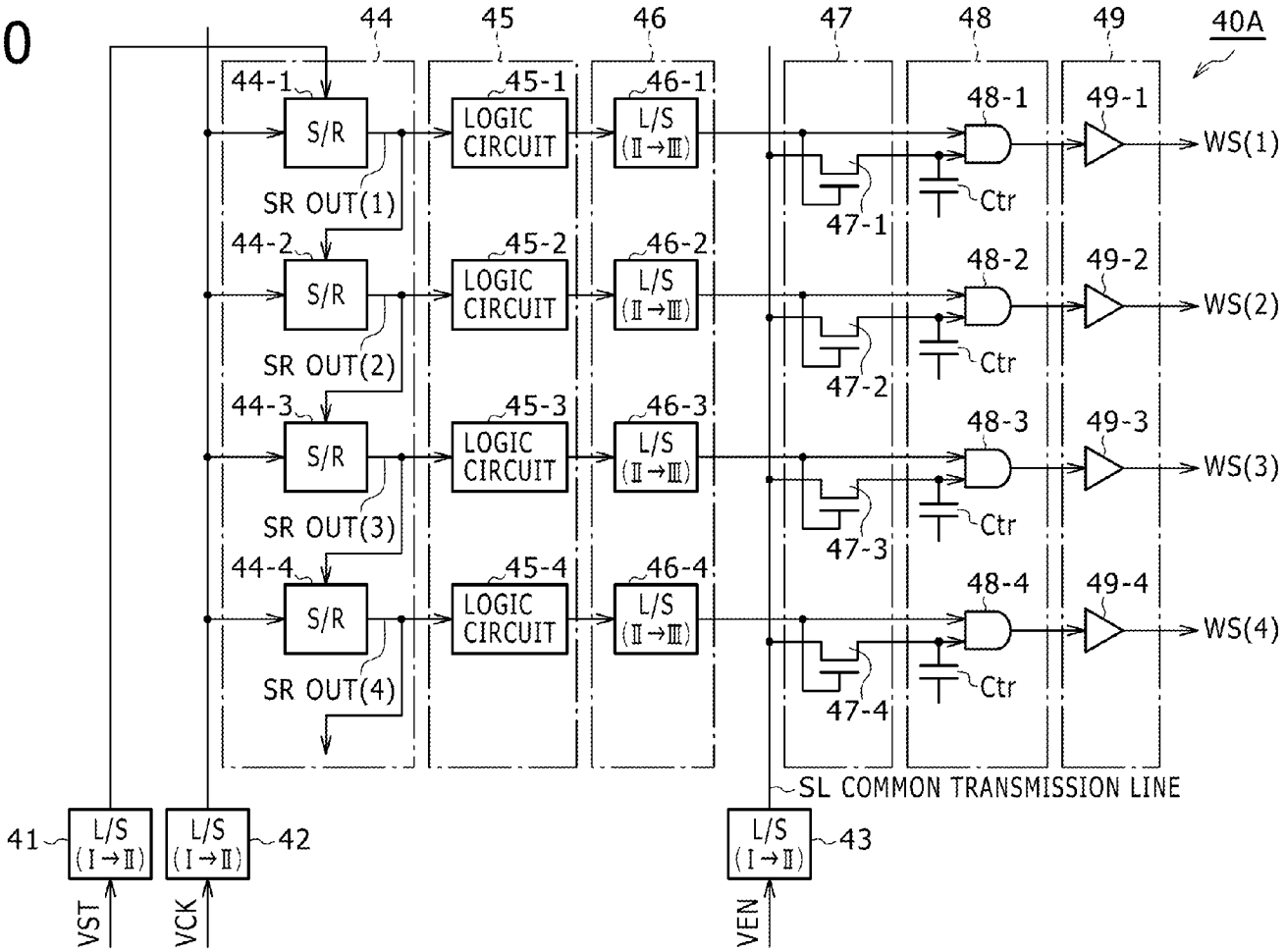
FIG. 10 is a block diagram showing a typical configuration of a write scan circuit according to a first embodiment.

FIG. 10 is a block diagram showing a typical configuration of the write scan circuit 40A according to the first embodiment. As shown in FIG. 10, the write scan circuit 40A according to the first embodiment employs level conversion circuits 41, 42 and 43, a shift register section 44, a first logic circuit section 45, a level shift circuit section 46, a switch section 47, a second logic circuit section 48 and a buffer section 49. In the following description, the level conversion circuits 41, 42 and 43 may also be referred to as L/S (level shift) circuits 41, 42 and 43 respectively. In order to make FIG. 10 simple, the typical configuration of the write scan circuit 40A is shown to include sections provided for four pixel rows which start with the first pixel row.

The write scan circuit 40A according to the first embodiment receives a vertical start pulse VST, a vertical clock signal VCK and a vertical enable signal VEN. Each of the vertical start pulse VST, the vertical clock signal VCK and the vertical enable signal VEN has an amplitude with a typical high level of 3 V and a typical low level of 0 V. It is to be noted that the vertical start pulse VST and the vertical clock signal VCK correspond to the start pulse sp and the clock pulse signal ck which are shown in FIG. 1. In the following description, the amplitude of each of the vertical start pulse VST, the vertical clock signal VCK and the vertical enable signal VEN is referred to as the amplitude of a first voltage system I, that is, the amplitude with a typical high level of 3 V and a typical low level of 0 V. In addition, in the following description, the high level of the amplitude is referred to simply as an H level whereas the low level of the amplitude is referred to simply as an L level.

In FIG. 10, the level shift circuits 41, 42 and 43 change the amplitude of the vertical start pulse VST, the vertical clock signal VCK and the vertical enable signal VEN respectively to an amplitude with a typical H level of 10 V and a typical L level of 0 V. If the write scan circuit 40 is particularly made of poly-silicon and implemented on a display panel 70, the amplitude with an H level of 10 V and an L level of 0 V is appropriate for the operation to drive the write scan circuit 40 which is made of poly-silicon. In addition, the amplitude with an H level of 10 V and an L level of 0 V is smaller than the amplitude of a signal appropriate for the operation to drive the organic EL device 21. In the following description, the amplitude which has an H level of 10 V and an L level of 0 V and is smaller than the amplitude of a signal appropriate for the operation to drive the organic EL device 21 is referred to as the amplitude of a second voltage system II. On the other hand, the amplitude of a signal appropriate for the operation to drive the organic EL device 21 is referred to as the amplitude of a third voltage system III.

The shift register section 44 is configured to employ S/Rs (shift registers) 44-1 to 44-4 which are wired to each other in accordance with the cascade connection technique. The shift registers 44-1 to 44-4 each serving as a unit circuit are associated with respectively the scan lines 31-1 to 31-4 of the pixel array section 30. The shift register section 44 sequentially shifts the vertical start pulse VST, which is received from the level shift circuit 41, synchronously with the vertical clock signal VCK received from the level shift circuit 42.

Thus, the shift registers 44-1 to 44-4 sequentially generate shift signals SR OUT (1) to SR OUT (4) respectively. The shift signals SR OUT (1) to SR OUT (4) sequentially generated along the time axis are original references of scan signals which are each used for selecting pixel circuits 20 employed in the pixel array section 30 in pixel-row units. That is to say, the shift signals SR OUT (1) to SR OUT (4) each generated along the time axis to serve as the origin of a reference signal to be described below are used for generating their respective scan signals. By the way, the scan signals each used for selecting pixel circuits 20 employed in the pixel array section 30 in pixel-row units are write scan signals WS1 to WSm shown in FIG. 1.

The first logic circuit section 45 is configured to employ logic circuits 45-1 to 45-4 which are associated with respectively the scan lines 31-1 to 31-4 of the pixel array section 30. The logic circuits 45-1 to 45-4 operate in the second voltage system II. The logic circuits 45-1 to 45-4 carry out logic processing determined in advance on the shift signals SR OUT (1) to SR OUT (4) which are received from respectively the shift registers 44-1 to 44-4 employed in the shift register section 44. Each of the logic circuits 45-1 to 45-4 outputs a pre-shift-conversion reference signal to the level shift circuit section 46.

It is to be noted that there may be a case in which the waveform of a specific scan signal is changed in accordance with another scan signal output to a scan line in close proximity to the specific scan signal. In another case, the waveforms of scan signals in the odd-numbered and even-numbered fields are interleaved with each other by adoption of an interleaving technique. In order to deal with such cases, the logic circuits 45-1 to 45-4 employed in the first logic circuit section 45 carry out complicated logic processing on respectively the shift signals SR OUT (1) to SR OUT (4) which are received from respectively the shift registers 44-1 to 44-4 employed in the shift register section 44.

The level shift circuit section 46 is configured to employ level shift circuits 46-1 to 46-4 which are associated with respectively the scan lines 31-1 to 31-4 of the pixel array section 30. The level shift circuits 46-1 to 46-4 change the amplitude of the pre-level-shift reference signals generated by respectively the logic circuits 45-1 to 45-4 employed in the first logic circuit section 45 from the amplitude of the second voltage system II to an amplitude which is proper for an operation to drive the organic EL device 21. The amplitude proper for an operation to drive the organic EL device 21 has a typical H level of 15 V and a typical L level of 0 V. In the following description, the amplitude appropriate for the operation to drive the organic EL device 21 is referred to as the amplitude of a third voltage system III as explained before. Each of the level shift circuits 46-1 to 46-4 outputs a post-level-shift reference signal to the switch section 47. In the following description, the post-level-shift reference signal is also referred to simply as a reference signal for the sake of description simplicity.

The switch section 47 is configured to employ switch devices 47-1 to 47-4 which are associated with respectively the scan lines 31-1 to 31-4 of the pixel array section 30. Each of the switch devices 47-1 to 47-4 is typically an Nch MOS transistor. Each of the Nch MOS transistors 47-1 to 47-4 is provided between the common transmission line SL and a specific input node of one of respectively logic circuits 48-1 to 48-4 employed in the second logic circuit section 48. The specific input node of any specific one of the logic circuits 48-1 to 48-4 employed in the second logic circuit section 48 is an input node formed on the specific one of the logic circuits 48-1 to 48-4 to serve as an input node for receiving the vertical enable signal VEN supplied to the specific one of the logic circuits 48-1 to 48-4 through the common transmission line SL.

The common transmission line SL is used for supplying the vertical enable signal VEN generated by the level shift circuit 43 at the amplitude of the second voltage system II as an enable signal common to the reference signals output by the level shift circuits 46-1 to 46-4 employed in the level shift register section 46 or common to the Nch MOS transistors 47-1 to 47-4 employed in the switch section 47. The reference signals output by the level shift circuits 46-1 to 46-4 employed in the level shift register section 46 are supplied to the other input nodes of respectively the logic circuits 48-1 to 48-4 employed in the second logic circuit section 48 and the gates of respectively the Nch MOS transistors 47-1 to 47-4 employed in the switch section 47 so that, when the reference signal is set at an H level, the Nch MOS transistor 47-1, 47-2, 47-3 or 47-4 receiving the reference signal is put in a turned-on state. In such a configuration, it is during a time period used for generating any specific one of the reference signals from the level shift circuits 46-1 to 46-4 employed in the level shift circuit section 46 to be supplied to respectively the logic circuits 48-1 to 48-4 employed in the second logic circuit section 48 that the specific input node formed on each of the logic circuit 48-1, 48-2, 48-3 or 48-4 provided for the specific reference signal to serve as an input node for receiving the vertical enable signal VEN is electrically connected by respectively the Nch MOS transistor 47-1, 47-2, 47-3 or 47-4 employed in the switch section 47 to the common transmission line SL. It is to be noted that the reference signals generated from the level shift circuits 46-1 to 46-4 employed in the level shift circuit section 46 to be supplied to respectively the logic circuits 48-1 to 48-4 employed in the second logic circuit section 48 are signals generated originally from the shift signals SR OUT (1) to SR OUT (4) output by respectively the S/Rs (shift registers) 44-1 to 44-4 employed in the shift register section 44 as described earlier.

The second logic circuit section 48 is configured to employ the aforementioned logic circuits 48-1 to 48-4 which are associated with respectively the scan lines 31-1 to 31-4 of the pixel array section 30. Each of the logic circuits 48-1 to 48-4 is typically an AND gate which has two input nodes. As described above, the other input node of each of the 2-input AND gates 48-1 to 48-4 employed in the second logic circuit section 48 is used for receiving a reference signal generated by respectively the level shift circuits 46-1 to 46-4 employed in the level shift circuit section 46. The reference signal is derived from one of the shift signals SR OUT (1) to SR OUT (4) which are output originally by respectively the S/Rs (shift registers) 44-1 to 44-4 employed in the shift register section 44. On the other hand, also as described above, the specific input node of each of the 2-input AND gates 48-1 to 48-4 is used for receiving the vertical enable signal VEN supplied from the level shift circuit 43 by way of respectively the Nch MOS transistor 47-1, 47-2, 47-3 or 47-4 which has been selectively turned on by the reference signal.

Then, each of the 2-input AND gates 48-1 to 48-4 computes the logical product of one of respectively the shift signals SR OUT (1) to SR OUT (4) output by respectively the S/Rs (shift registers) 44-1 to 44-4 employed in the shift register section 44 and the vertical enable signal VEN in order to generate an output signal which changes the level thereof with the rising and falling timings of the vertical enable signal VEN. The 2-input AND gates 48-1 to 48-4 supply the output signals to respectively the scan lines 31-1 to 31-4 of the pixel array section 30 by way of respectively buffers 49-1 to 49-4 employed in the buffer section 49. The output signals supplied by the 2-input AND gates 48-1 to 48-4 to respectively the scan lines 31-1 to 31-4 of the pixel array section 30 by way of respectively the buffers 49-1 to 49-4 employed in the buffer section 49 are referred to as write scan signals WS (1) to WS (4) respectively.

Figure 11:
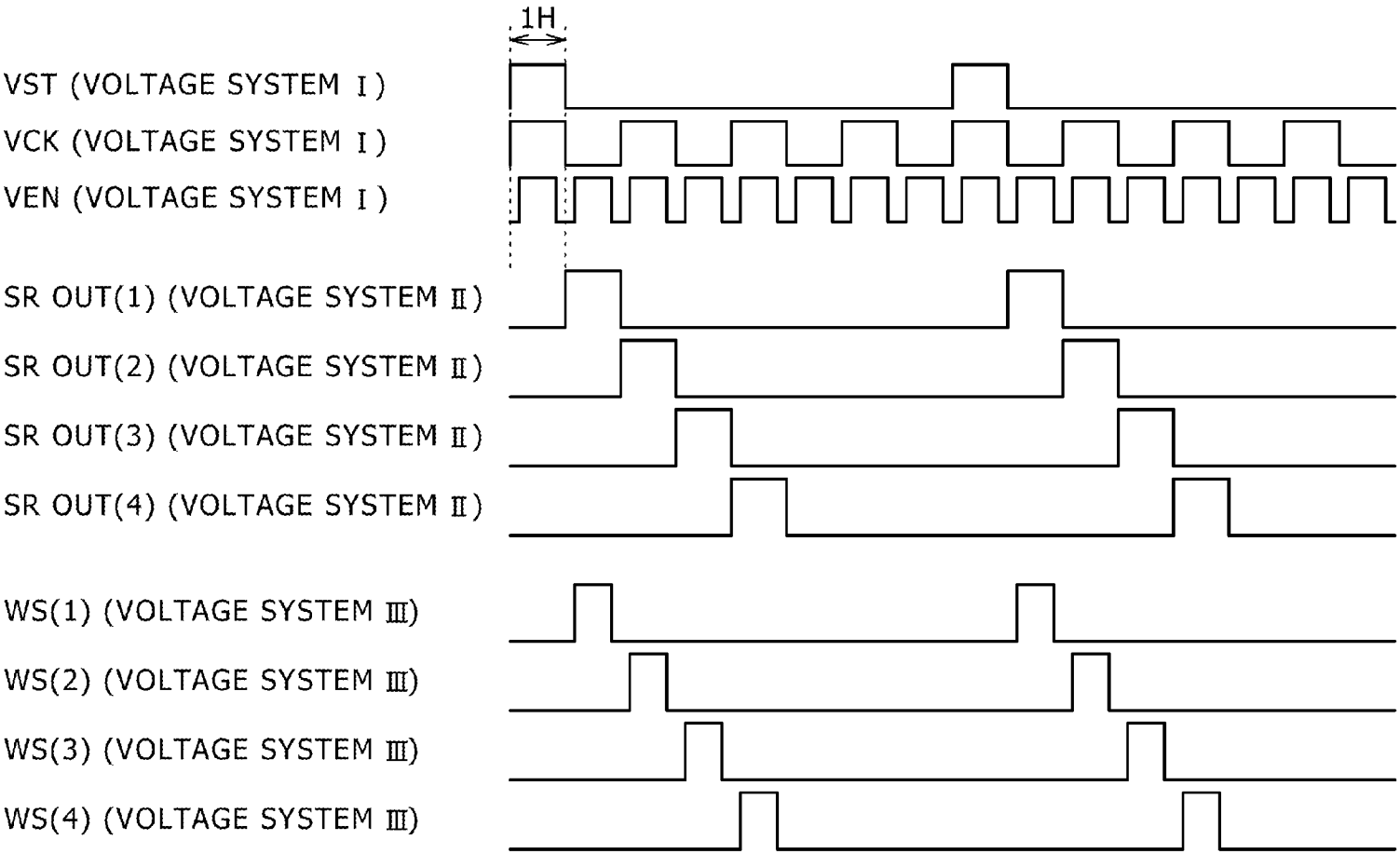
FIG. 11 is a timing/waveform diagram showing relations among timings of vertical start pulses VST each having the amplitude of a first voltage system I, a vertical clock signal VCK having the amplitude of the first voltage system I, a vertical enable signal VEN having the amplitude of a first voltage system I, shift signals SR OUT (1) to SR OUT (4) each having the amplitude of a second voltage system II and write scan signals WS (1) to WS (4) each having the amplitude of a third voltage system III.

FIG. 11 is a timing/waveform diagram showing relations among timings of the vertical start pulses VST each having the amplitude of a first voltage system I, the vertical clock signal VCK having the amplitude of the first voltage system I, the vertical enable signal VEN having the amplitude of the first voltage system I, the shift signals SR OUT (1) to SR OUT (4) each having the amplitude of a second voltage system II and the write scan signals WS (1) to WS (4) each having the amplitude of a third voltage system III. As is obvious from the timing/waveform diagram of FIG. 11, the vertical enable signal VEN is a pulse signal which rises and falls down once a 1H where notation H denotes the horizontal scan period. The timing with which vertical enable signal VEN rises is referred to as a rising timing. On the other hand, the timing with which vertical enable signal VEN falls down is referred to as a falling timing. As explained earlier, the rising and falling timings of the vertical enable signal VEN prescribe the rising and falling timings of the write scan signals WS (1) to WS (4).

First Typical Level Shift Circuit for Voltage System I→Voltage System II

Figure 12:
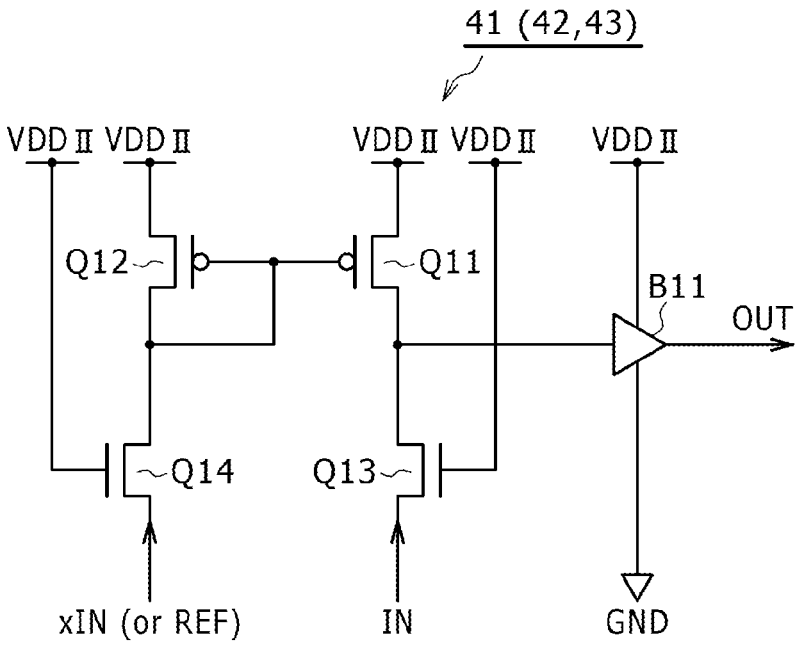
FIG. 12 is a circuit diagram showing a first typical level shift circuit for changing an amplitude from the amplitude of the first voltage system I to the amplitude of the second voltage system II.

FIG. 12 is a circuit diagram showing a first typical example of the level shift circuits 41, 42 and 43 for changing an amplitude from the amplitude of the first voltage system I to the amplitude of the second voltage system II.

The first typical example of the level shift circuits 41, 42 and 43 is a level shift circuit of the so-called current-mirror type. As shown in the figure, the typical level shift circuit of the so-called current-mirror type employs Pch MOS transistors Q11 and Q12. The source electrodes of the Pch MOS transistors Q11 and Q12 are connected to a positive-side power supply VDDII for generating power at a level which corresponds to the H level of the second voltage system II. The Pch MOS transistors Q11 and Q12 form a current mirror circuit. The gate electrode of the Pch MOS transistor Q12 is connected to the drain electrode of the Pch MOS transistor Q12 and the gate electrode of the Pch MOS transistor Q11.

The drain electrode of the Pch MOS transistor Q11 is connected to the drain electrode of an Nch MOS transistor Q13 whereas the drain electrode of the Pch MOS transistor Q12 is connected to the drain electrode of an Nch MOS transistor Q14. The gate electrodes of the Nch MOS transistors Q13 and Q14 are connected to the positive-side power supply VDDII. The source electrode of the Nch MOS transistor Q13 receives an input signal IN having an amplitude equal to the amplitude of the first voltage system I whereas the source electrode of the Nch MOS transistor Q14 receives an inverted input signal xIN which is obtained by inverting the input signal IN.

It is to be noted that, in some configurations, the source electrode of the Nch MOS transistor Q14 receives a reference voltage REF having a constant level in place of the inverted input signal xIN. In such configurations, the constant level of the reference voltage REF is approximately equal to the average of the H and L levels of the input signal IN.

The first typical example of the level shift circuit 41, 42 or 43 receives the vertical start pulse VST, the vertical clock signal VCK or the vertical enable signal VEN respectively as the input signal IN. As described before, each of the vertical start pulse VST, the vertical clock signal VCK and the vertical enable signal VEN has an amplitude equal to the amplitude of the first voltage system I. The Nch MOS transistors Q13 and Q14 are turned on and off complementarily to each other in accordance with the input signal IN and the inverted input signal xIN so that voltages appearing on the drain electrodes of the Nch MOS transistors Q13 and Q14 vary at an amplitude equal to the amplitude of the second voltage system II.

The first typical example of the level shift circuit 41, 42 or 43 outputs the voltage appearing on the drain electrode of the Nch MOS transistor Q13 as an output signal OUT to a circuit external to the level shift circuits 41, 42 or 43 respectively by way of a buffer circuit B11 which is driven to operate by the second voltage system II serving as a power supply. In this way, the first typical example of the level shift circuit 41, 42 or 43 converts respectively the vertical start pulse VST, the clock signal VCK and the vertical enable signal VEN supplied thereto as the input signal IN having an amplitude equal to the amplitude of the first voltage system I into the output signal OUT having an amplitude equal to the amplitude of the second voltage system II.

Figure 13:
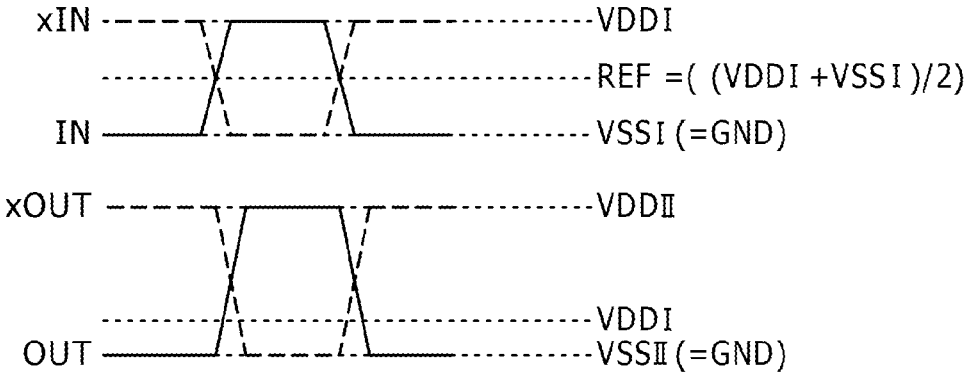
FIG. 13 is a timing/waveform diagram showing the waveforms of an input signal IN and an inverted input signal xIN as well as an output signal OUT and an inverted output signal xOUT in the first typical level shift circuit shown in the circuit diagram of FIG. 12.

FIG. 13 is a timing/waveform diagram showing the waveforms of the input signal IN and the inverted input signal xIN as well as the output signal OUT and the inverted output signal xOUT in the first typical level shift circuit. The inverted output signal xOUT is a signal obtained by inverting the output signal OUT. A voltage VSSII shown in the timing/waveform diagram of FIG. 13 is the voltage of a negative-side power supply. The voltage of the negative-side power supply VSSII corresponds to the L level of the second voltage system II and the GND (ground) level of the first typical level shift circuit shown in the circuit diagram of FIG. 12.

Second Typical Level Shift Circuit for Voltage System I→Voltage System II

Figure 14:
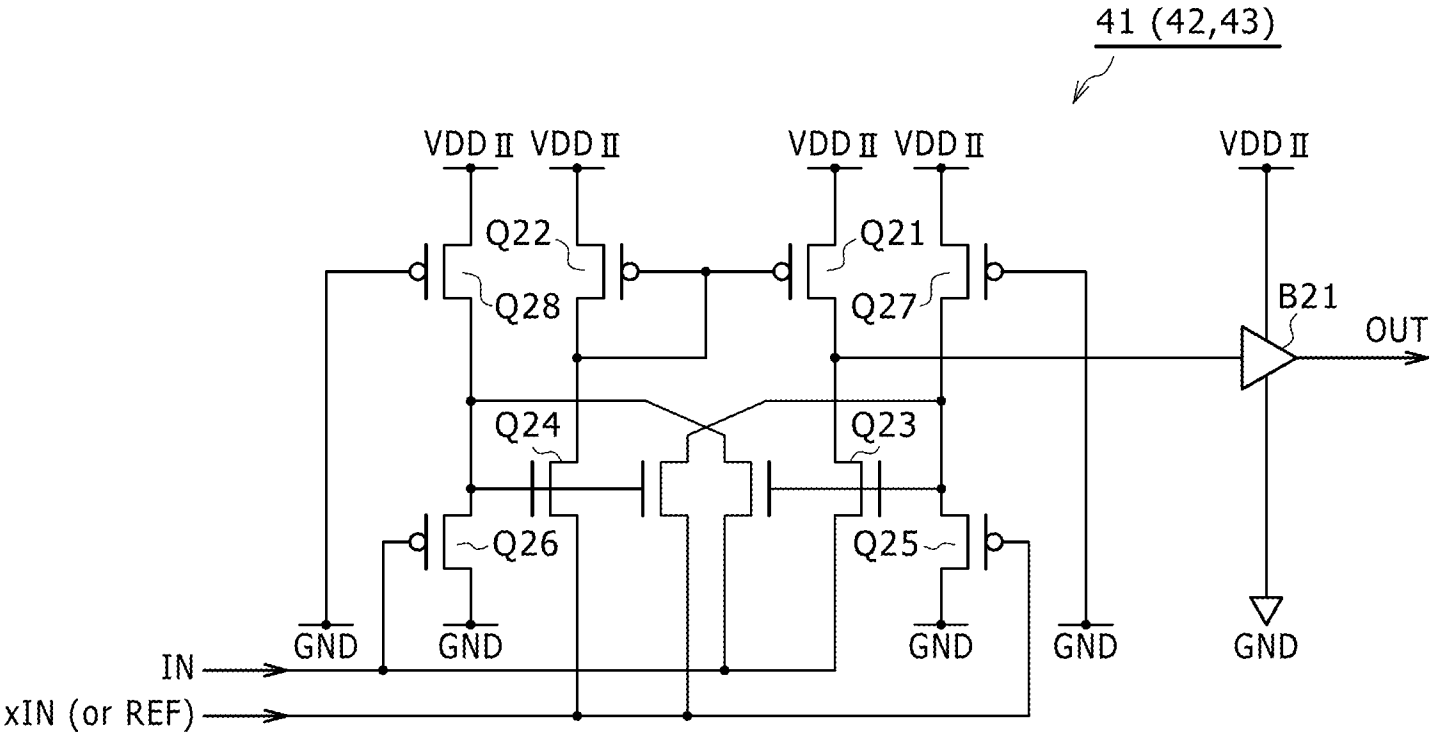
FIG. 14 is a circuit diagram showing a second typical level shift circuit for changing an amplitude from the amplitude of the first voltage system I to the amplitude of the second voltage system II.

FIG. 14 is a circuit diagram showing a second typical example of the level shift circuits 41, 42 and 43 for changing an amplitude from the amplitude of the first voltage system I to the amplitude of the second voltage system II.

Much like the first typical example of the level shift circuits 41, 42 and 43, the second typical example of the level shift circuits 41, 42 and 43 is also a level shift circuit of the so-called current-mirror type. As shown in the figure, the second typical level shift circuit of the so-called current-mirror type employs Pch MOS transistors Q21 and Q22. The source electrodes of the Pch MOS transistors Q21 and Q22 are connected to the positive-side power supply VDDII. The Pch MOS transistors Q21 and Q22 form a current mirror circuit. The gate electrode of the Pch MOS transistor Q22 is connected to the drain electrode of the Pch MOS transistor Q22 and the gate electrode of the Pch MOS transistor Q21.

The drain electrode of the Pch MOS transistor Q21 is connected to the drain electrode of an Nch MOS transistor Q23 whereas the drain electrode of the Pch MOS transistor Q22 is connected to the drain electrode of an Nch MOS transistor Q24. The gate electrodes of the Nch MOS transistors Q23 and Q24 are connected to the positive-side power supply VDDII through Pch MOS transistors Q27 and Q28 respectively. The source electrode of the Nch MOS transistor Q23 receives an input signal IN having an amplitude equal to the amplitude of the first voltage system I whereas the source electrode of the Nch MOS transistor Q24 receives an inverted input signal xIN which is obtained by inverting the input signal IN. The second typical example of the level shift circuit 41, 42 or 43 outputs the voltage appearing on the drain electrode of the Nch MOS transistor Q23 as an output signal OUT to a circuit external to the level shift circuits 41, 42 or 43 respectively by way of a buffer circuit B21 which is driven to operate by the second voltage system II serving as a power supply.

In addition, the second typical example of the level shift circuits 41, 42 and 43 also employs a Pch MOS transistor Q25 which has the source electrode thereof connected to the ground and the gate electrode thereof provided with the inverted input signal xIN. On top of that, the second typical example of the level shift circuits 41, 42 and 43 also employs a Pch MOS transistor Q26 which has the source electrode thereof connected to the ground and the gate electrode thereof provided with the input signal IN. The drain electrode of the Pch MOS transistor Q25 is connected to gate electrode of the Nch MOS transistor Q23 whereas the drain electrode of the Pch MOS transistor Q26 is connected to gate electrode of the Nch MOS transistor Q24. Thus, the drain electrode of the Pch MOS transistor Q25 is connected to the second voltage system II through the Pch MOS transistor Q27 whereas the drain electrode of the Pch MOS transistor Q26 is connected to the second voltage system II through the Pch MOS transistor Q28. Each of the gate electrodes of the Pch MOS transistors Q27 and Q28 is connected to the ground GND.

The drain electrode of the Pch MOS transistor Q25 is also connected to the drain electrode of an Nch MOS transistor Q30 whereas the drain electrode of the Pch MOS transistor Q26 is connected to the drain electrode of an Nch MOS transistor Q29. The gate electrode of the Nch MOS transistor Q29 is connected to the drain electrode of the Pch MOS transistor Q25 whereas the gate electrode of the Nch MOS transistor Q30 is connected to the drain electrode of the Pch MOS transistor Q26. The source electrode of the Nch MOS transistor Q29 receives the input signal IN whereas the source electrode of the Nch MOS transistor Q30 receives the inverted input signal xIN.

It is to be noted that, in some configurations, the source electrode of the Nch MOS transistor Q24, the gate electrode of the Pch MOS transistor Q25 and the source electrode of the Nch MOS transistor Q30 receive a reference voltage REF having a constant level in place of the inverted input signal xIN. In such configurations, the constant level of the reference voltage REF is approximately equal to the average of the H and L levels of the input signal IN.

The second typical example of the level shift circuit 41, 42 or 43 converts respectively the vertical start pulse VST, the clock signal VCK and the vertical enable signal VEN supplied thereto as the input signal IN having an amplitude equal to the amplitude of the first voltage system I into the output signal OUT having an amplitude equal to the amplitude of the second voltage system II at a sufficiently large feedback gain by turning the Nch MOS transistors Q23 and Q24 on and off.

Figure 15:
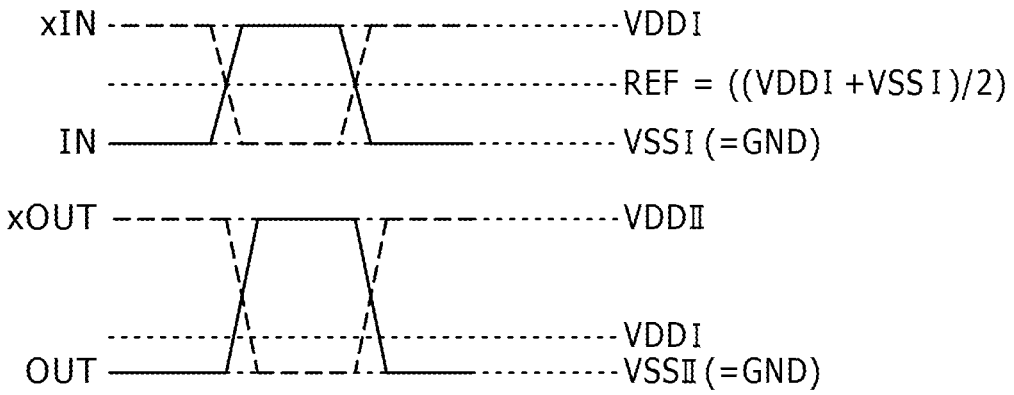
FIG. 15 is a timing/waveform diagram showing the waveforms of an input signal IN and an inverted input signal xIN as well as an output signal OUT and an inverted output signal xOUT in the second typical level shift circuit shown in the circuit diagram of FIG. 14.

FIG. 15 is a timing/waveform diagram showing the waveforms of the input signal IN and the inverted input signal xIN as well as the output signal OUT and the inverted output signal xOUT in the second typical level shift circuit. The inverted output signal xOUT is a signal obtained by inverting the output signal OUT. A voltage VSSII shown in FIG. 15 is the voltage of a negative-side power supply. The voltage of the negative-side power supply corresponds to the L level of the second voltage system II and the GND (ground) level of the second typical level shift circuit shown in FIG. 14.

The above description explains two typical level shift circuits, i.e., the first and second typical level shift circuits 41, 42 and 43 for changing amplitudes from the amplitude of the first voltage system I to the amplitude of the second voltage system II. It is to be noted, however, that the level shift circuits 41, 42 and 43 are by no means limited to these two typical level shift circuits. That is to say, it is possible to make use of a variety of level shift circuits which each have a configuration different from those of the two typical level shift circuits.

Typical Level Shift Circuit for Voltage System II→Voltage System III

Figure 16:
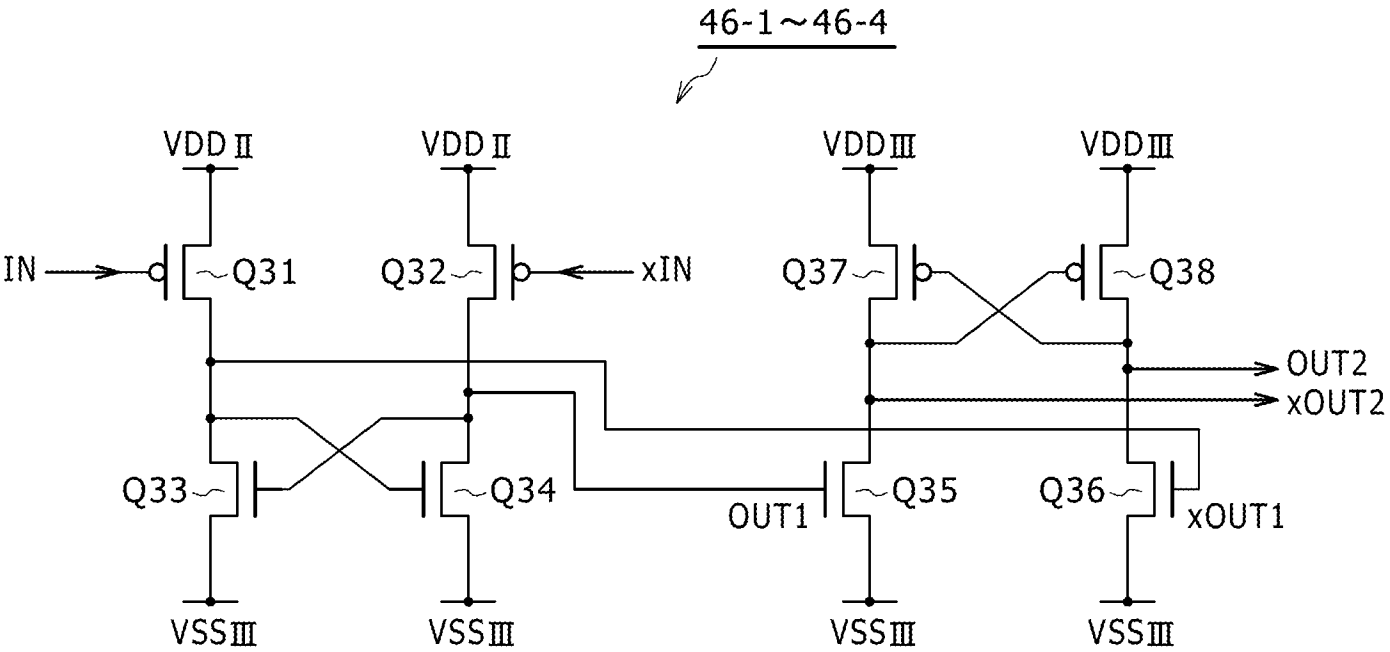
FIG. 16 is a circuit diagram showing a typical level shift circuit for changing the amplitude of a reference signal from the amplitude of the second voltage system II to the amplitude of the third voltage system III.

FIG. 16 is a circuit diagram showing a typical example of the level shift circuits 46-1 to 46-4 for changing the amplitude of a reference signal from the amplitude of the second voltage system II to the amplitude of the third voltage system III.

The typical example of the level shift circuits 46-1 to 46-4 is a level shift circuit of the so-called latch type. As shown in the figure, the typical level shift circuit of the so-called latch type employs Pch MOS transistors Q31 and Q32. The source electrodes of the Pch MOS transistors Q31 and Q32 are connected to the positive-side power supply VDDII which corresponds to the H level of the second voltage system II. The gate electrode of the Pch MOS transistor Q31 receives an input signal IN having an amplitude equal to the amplitude of the second voltage system II whereas the gate electrode of the Pch MOS transistor Q32 receives an inverted input signal xIN which is obtained by inverting the input signal IN.

The drain electrode of the Pch MOS transistor Q31 is connected to a negative-side power supply VSSIII corresponding to the L level of the third voltage system III through an Nch MOS transistor Q33 whereas the drain electrode of the Pch MOS transistor Q32 is connected to the negative-side power supply VSSIII through an Nch MOS transistor Q34. The gate electrode of the Nch MOS transistor Q33 is connected to the drain electrode of the Nch MOS transistor Q34 whereas the gate electrode of the Nch MOS transistor Q34 is connected to the drain electrode of the Nch MOS transistor Q33. In this configuration, each of the level shift circuits 46-1 to 46-4 changes a voltage appearing on the drain electrode of each of the Nch MOS transistors Q33 and Q34 from the H level of the second voltage system II to the L level of the third voltage system III and vice versa by turning the Pch MOS transistors Q31 and Q32 complementarily to each other in accordance with the input signal IN and the inverted input signal xIN which each have an amplitude equal to the amplitude of the second voltage system II.

The voltage appearing on the drain electrode of the Nch MOS transistor Q33 is supplied to the gate electrode of a Nch MOS transistor Q36 as an inverted intermediate output signal xOUT1 whereas the voltage appearing on the drain electrode of the Nch MOS transistor Q34 is supplied to the gate electrode of a Nch MOS transistor Q35 as an intermediate output signal OUT1. The source electrodes of the Nch MOS transistors Q35 and Q36 are connected to the negative-side power supply VSSIII which corresponds to the L level of the third voltage system III. The drain electrode of the Nch MOS transistor Q35 is connected to a positive-side power supply VDDIII corresponding to the H level of the third voltage system III through a Pch MOS transistor Q37 whereas the drain electrode of the Nch MOS transistor Q36 is connected to the positive-side power supply VDDIII through a Pch MOS transistor Q38.

The gate electrode of the Pch MOS transistor Q37 is connected to the drain electrode of the Pch MOS transistor Q38 whereas the gate electrode of the Pch MOS transistor Q38 is connected to the drain electrode of the Pch MOS transistor Q37. In this configuration, each of the level shift circuits 46-1 to 46-4 changes a voltage appearing on the drain electrode of each of the Nch MOS transistors Q35 and Q36 from the H level of the third voltage system III to the L level of the third voltage system III and vice versa in accordance with the inverted intermediate output signal xOUT2 and the intermediate output signal OUT2, that is, in accordance with the input signal IN and the inverted input signal xIN which each have an amplitude equal to the amplitude of the second voltage system II. Each of the level shift circuits 46-1 to 46-4 outputs the voltage appearing on the drain electrode of each of the Nch MOS transistors Q35 and Q36 as an inverted final output signal OUT2 and a final output signal xOUT2 respectively.

As is generally known, the typical level shift circuit of the latch type has a power consumption smaller than that of the first and second level shift circuits of the current-mirror type. In particular, each of the level shift circuits 46-1 to 46-4 represented by the typical level shift circuit of the latch type for changing the amplitude of a reference signal from the amplitude of the second voltage system II to the amplitude of the third voltage system III is provided for one of the scan lines 31-1 to the 31-*m* of the pixel array section 30. Thus, the number of level shift circuits 46-1 to 46-4 desired for constructing the write scan circuit 40A is inevitably large. By making use of latch-type level shift circuits 46-1 to 46-4 desired for constructing the level shift circuit section 46, however, the power consumption of the write scan circuit 40A becomes small in comparison with that of a write scan circuit 40 which employs level shift circuits 46-1 to 46-4 of the current-mirror type. As a result, the organic EL display apparatus 10 employing the write scan circuit 40A having level shift circuits 46-1 to 46-4 of the latch type offers a merit of a substantially reduced power consumption.

FIG. 17 is a timing/waveform diagram showing the waveforms of the input signal IN and the inverted input signal xIN, the intermediate output signal OUT1 and the inverted intermediate output signal xOUT1 as well as the final output signal OUT2 and the inverted final output signal xOUT2 in the typical level shift circuit shown in FIG. 16.

Logic Circuits of the Second Logic Circuit Section

FIG. 18 is a diagram showing the symbol of each of 2-input AND gates 48-1 to 48-4 which each serve as a 2-input logical-product circuit employed in the second logic section 48. Each of the 2-input AND gates 48-1 to 48-4 computes a logical product of two input signals IN1 and IN supplied thereto, outputting the logical product as an output signal OUT. FIG. 19 is a diagram showing the truth table of the 2-input AND gates 48-1 to 48-4 which are each also referred to as a 2-input AND gate.

Figure 20:
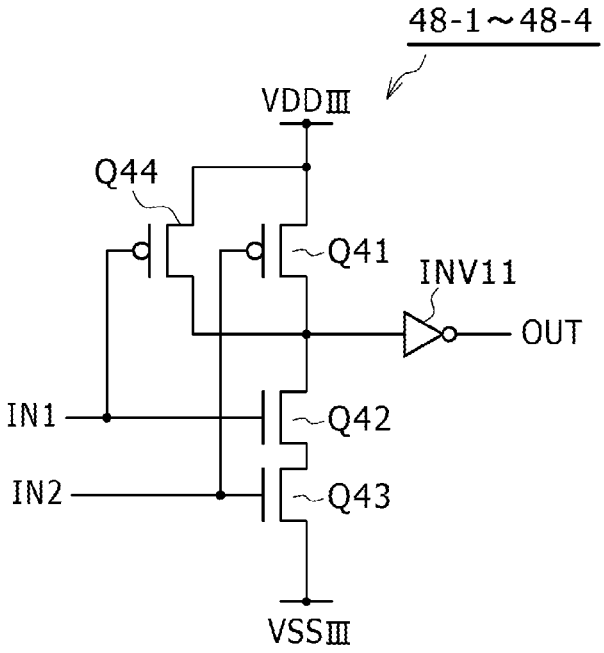
FIG. 20 is a circuit diagram showing a typical concrete configuration of a 2-input AND gate.

FIG. 20 is a circuit diagram showing a typical concrete configuration of each of the 2-input AND gates 48-1 to 48-4. As shown in FIG. 20, each of the 2-input AND gates 48-1 to 48-4 is driven to operate by the positive-side power supply VDDIII corresponding to the H level of the third voltage system III and the negative-side power supply VSSIII corresponding to the L level of the third voltage system III. Each of the 2-input AND gates 48-1 to 48-4 employs a Pch MOS transistor Q41 as well as Nch MOS transistors Q42 and Q43. The Pch MOS transistor Q41, the Nch MOS transistor Q42 and the Nch MOS transistor Q43 are connected to each other in series between the positive-side power supply VDDIII and the negative-side power supply VSSIII. The Pch MOS transistor Q41 and a Pch MOS transistor Q44 are connected to the level shift circuit 42 to form a parallel circuit.

The gate electrodes of the Nch MOS transistors Q42 and Q43 serve as respectively the two input nodes of each of the AND gates 48-1 to 48-4. The gate electrodes of the Nch MOS transistors Q42 and Q43 receive the two input signals IN1 and IN2 respectively. A specific one of the two input nodes of each of the AND gate 48-1 to 48-4 is used as an input node for receiving the vertical enable signal VEN. That is to say, the vertical enable signal VEN is supplied to each of the AND gates 48-1 to 48-4 as one of the two input signals IN1 and IN2. The other one of the two input nodes of each of the AND gate 48-1 to 48-4 is used as an input node for receiving a reference signal output by the level shift circuit section 46. The specific input node used for receiving the vertical enable signal VEN is selected to serve as an input node to be connected electrically by an Nch MOS transistor employed in the switch section 47 to the common transmission line SL which propagates the vertical enable signal VEN. A voltage appearing on the drain electrode of the Nch MOS transistor Q42 is output to the buffer section 49 by way of an inverter circuit INV41 as the output signal OUT.

Effects of the Write Scan Circuit According to the First Embodiment

The write scan circuit 40A according to the first embodiment includes shift level circuits 46-1 to 46-4 each provided for one of a plurality of scan lines. The shift level circuits 46-1 to 46-4 change the amplitudes of shift signals SR OUT (1) to SR OUT (4) respectively from a first amplitude to a second amplitude. In the case of this embodiment, the first amplitude is the amplitude of the second voltage system II whereas the second amplitude is the amplitude of the third voltage system III. As described before, each of the shift signals SR OUT (1) to SR OUT (4) is an original reference signal from which one of write scan signals WS (1) to WS (4) respectively is generated as shown in FIG. 10.

Also as described earlier, by making use of the latch-type level shift circuits 46-1 to 46-4 desired for constructing the level shift circuit section 46, the power consumption of the write scan circuit 40A becomes small in comparison with that of a write scan circuit 40 which employs level shift circuits 46-1 to 46-4 of the current-mirror type. On the other side of the coin, if the write scan circuit 40 is made of poly-silicon in particular, the propagation delay time varies among the level shift circuits 46-1 to 46-4 due to variations in characteristics among circuit elements employed in the level shift circuits 46-1 to 46-4. With such delay-time variations, the timing relation among the shift signals SR OUT (1) to SR OUT (4) eventually supplied to the level shift circuits 46-1 to 46-4 respectively by way of the logic circuits 45-1 to 45-4 respectively also varies among the level shift circuits 46-1 to 46-4.

As described above, the shift signals SR OUT (1) to (4) are original reference signals from which write scan signals WS (1) to (4) are generated respectively along the time axis. Thus, if the timing relation among the shift signals SR OUT (1) to SR OUT (4) supplied to the level shift circuits 46-1 to 46-4 respectively by way of the logic circuits 45-1 to 45-4 respectively varies among the level shift circuits 46-1 to 46-4, the timing relation among the write scan signals WS (1) to (4) also varies as well among the scan lines 31-1 to the 31-4 of the pixel array section 30. The varying timing relation among the write scan signals WS (1) to (4) among the scan lines 31-1 to the 31-4 of the pixel array section 30 has a variety of bad effects on an image displayed by the organic EL display apparatus 10.

In order to solve the problems described above, the write scan circuit 40A according to the first embodiment is configured to supply the vertical enable signal VEN to the second logic circuit section 48 through the common transmission line SL as a vertical enable signal common to the shift signals SR OUT (1) to SR OUT (4) serving as reference signals from which write scan signals WS (1) to (4) are generated respectively. Thus, the rising and falling timings of the write scan signals WS (1) to (4) are prescribed by the rising and falling timings of the vertical enable signal VEN. As a result, it is possible to prevent the timing relation among the write scan signals WS (1) to (4) from varying due to the varying propagation delay time among the level shift circuits 46-1 to 46-4 for a configuration in which each of the level shift circuits 46-1 to 46-4 is provided for one of respectively the scan lines 31-1 to the 31-4 of the pixel array section 30 as is the case with the write scan circuit 40A according to the first embodiment.

As obvious from description given before with reference to the timing/waveform diagram of FIG. 4 as description of the basic operations, the organic EL display apparatus 10 according to the embodiments of the present invention has a threshold compensation function and a mobility compensation function. As explained earlier, the threshold compensation function is a function executed for compensating a pixel circuit 20 for variations of the threshold voltage Vth of the driving transistor 22 employed in the pixel circuit 20 whereas the mobility compensation function is a function executed for compensating a pixel circuit 20 for variations of the mobility μ of the driving transistor 22 employed in the pixel circuit 20.

As obvious from the timing/waveform diagram of FIG. 4, each of the threshold compensation period and the mobility compensation period is determined by the length of an active period of the write scan signal WS output by the write scan circuit 40 employed in the organic EL display apparatus 10 shown in FIG. 1, in other words, by the pulse width. In order to set the threshold compensation period and the mobility compensation period, the write scan circuit 40 activates the write scan signal WS twice in a 1-H period. In addition, if a driving method for carrying out the so-called split threshold compensation processing is adopted, the write scan circuit 40 has to activate the write scan signal WS a plurality of times. To put it more concretely, the write scan circuit 40 has to activate the write scan signal WS once in a 1-H period in which threshold compensation processing is carried out along with mobility compensation processing and signal write processing and has to also activate the write scan signal WS once or more times over a plurality of horizontal scan periods leading ahead of the 1-H period.

As described above, the write scan signal WS output by the write scan circuit 40 is a signal for carrying out signal write processing and determining the threshold compensation period and the mobility compensation period. Thus, it is possible to prevent the timing relation among the write scan signals WS (1) to (4) from varying due to the varying propagation delay time among the level shift circuits 46-1 to 46-4. As a result, since each of the threshold compensation processing and the mobility compensation processing can be carried out with a high degree of reliability, it is possible to improve the quality of an image displayed by the organic EL display apparatus 10.

In particular, the mobility compensation processing is carried out by raising the voltage Vs appearing on the source electrode of the driving transistor 22 as described before. Thus, if the mobility compensation period varies among driving transistors 22, the increase of the voltage Vs appearing on the source electrode of the driving transistor 22 also varies among pixel circuits 20. For example, if the mobility compensation period of a driving transistor 22 becomes longer, the increase of the voltage Vs appearing on the source electrode of the driving transistor 22 also becomes larger. If the increase of the voltage Vs appearing on the source electrode of the driving transistor 22 also becomes larger, the voltage Vgs appearing between the gate and source electrodes of the driving transistor 22 decreases. Thus, the luminance of light emitted by the organic EL device 21 decreases with the lapse of time. As a result, the quality of an image displayed by the organic EL display apparatus 10 deteriorates. Typical examples of the deterioration of the displayed-image quality are screen cords and luminance unevenness.

In the case of the organic EL display apparatus 10 employing the write scan circuit 40A according to the first embodiment, on the other hand, the variations of the mobility compensation period become smaller. This is because, as described above, the mobility compensation period is determined by the length of the waveform of the write scan signal WS which has the rising and falling timings thereof prescribed by the vertical enable signal VEN with a high degree of reliability. To put it more concretely, the mobility compensation period is determined by the pulse width of the waveform of the write scan signal WS which has the rising and falling timings thereof prescribed by the vertical enable signal VEN with a high degree of reliability. It is thus possible to prevent the voltage Vs appearing on the source electrode of the driving transistor 22 from varying among pixel circuits 20 due to the varying mobility compensation period among the pixel circuits 20. Accordingly, since variations of a current flowing through the organic EL device 21 among pixel circuits 20 decrease, it is possible to prevent the luminance of light emitted by the organic EL device 21 from varying among the pixel circuits 20 with the lapse of time and the quality of an image displayed by the organic EL display apparatus 10 from deteriorating. As described above, typical examples of the deterioration of the displayed-image quality are screen cords and luminance unevenness.

By the way, as is obvious from the timing/waveform diagram of FIG. 11, the vertical enable signal VEN is a pulse signal which rises and falls down once a 1H where notation H denotes the horizontal scan period. As described earlier, the timing with which vertical enable signal VEN rises is referred to as a rising timing. On the other hand, the timing with which vertical enable signal VEN falls down is referred to as a falling timing. Thus, the vertical enable signal VEN generated by the level shift circuit 43 electrically charges and discharges the common transmission line SL once a 1H. As shown in FIG. 10, the common transmission line SL is connected to capacitors Ctr of the AND gates 48-1 to 48-4 employed in the second logic circuit section 48. The capacitors Ctr are each a capacitor of a transistor employed in each one of the AND gates 48-1 to 48-4. In each of the AND gates 48-1 to 48-4 each shown in FIG. 20, the transistor employed in each of the AND gates 48-1 to 48-4 is the Nch MOS transistor Q42 or Q43.

Figure 21:
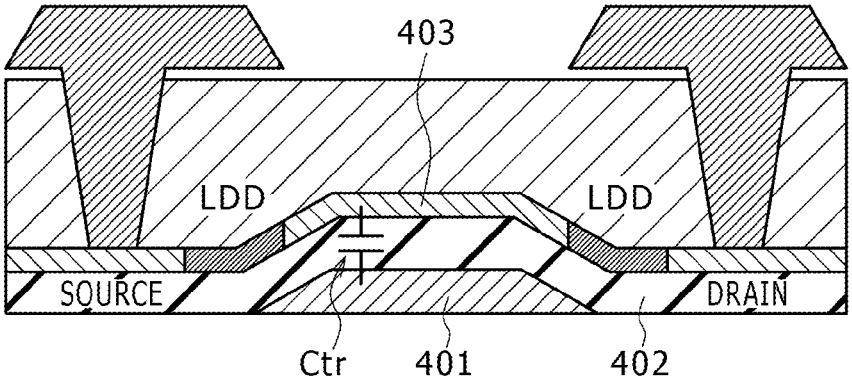
FIG. 21 is a cross-sectional diagram showing the cross-sectional structure of a transistor.

As shown in FIG. 21, the capacitor Ctr of the transistor is created in a gate insulation film 402 of the transistor. The gate insulation film 402 of the transistor is sandwiched by the gate electrode 401 of the transistor and the channel area 403 of the transistor. If the common transmission line SL is connected to the capacitors Ctr of all the AND gates 48-1 to 48-4 for their respective scan lines 31 of the pixel array section 30 directly without making use of the switch section 47, the capacitance of a total load borne by the common transmission line SL is large. Thus, the power consumption of operations to electrically charge and discharge the vertical enable signal VEN onto and from the common transmission line SL is also large.

In the case of the configuration of the write scan circuit 40A according to the first embodiment, on the other hand, the switch section 47 is provided between the common transmission line SL and the second logic circuit section 48. To put it in detail, the Nch MOS transistor 47-1 employed in the switch section 47 is provided between the common transmission line SL and an input node formed on the AND gate 48-1 employed in the second logic circuit section 48 to serve as the input node for receiving the vertical enable signal VEN. By the same token, the Nch MOS transistor 47-2 employed in the switch section 47 is provided between the common transmission line SL and an input node formed on the AND gate 48-2 employed in the second logic circuit section 48 to serve as the input node for receiving the vertical enable signal VEN. In the same way, the Nch MOS transistor 47-3 employed in the switch section 47 is provided between the common transmission line SL and an input node formed on the AND gate 48-3 employed in the second logic circuit section 48 to serve as the input node for receiving the vertical enable signal VEN. Likewise, the Nch MOS transistor 47-4 employed in the switch section 47 is provided between the common transmission line SL and an input node formed on the AND gate 48-4 employed in the second logic circuit section 48 to serve as the input node for receiving the vertical enable signal VEN. The Nch MOS transistors 47-1 to 47-4 each serving as a switch device are put in a turned-on state during periods allocated to the generations of the shift signals SR OUT (1) to SR OUT (4) respectively. With the Nch MOS transistor 47-1 put in a turned-on state, the common transmission line SL is electrically connected to an input node formed on the AND gate 48-1 employed in the second logic circuit section 48 to serve as the input node for receiving the vertical enable signal VEN. By the same token, with the Nch MOS transistor 47-2 put in a turned-on state, the common transmission line SL is electrically connected to an input node formed on the AND gate 48-2 employed in the second logic circuit section 48 to serve as the input node for receiving the vertical enable signal VEN. In the same way, with the Nch MOS transistor 47-3 put in a turned-on state, the common transmission line SL is electrically connected to an input node formed on the AND gate 48-3 employed in the second logic circuit section 48 to serve as the input node for receiving the vertical enable signal VEN. Similarly, with the Nch MOS transistor 47-4 put in a turned-on state, the common transmission line SL is electrically connected to an input node formed on the AND gate 48-4 employed in the second logic circuit section 48 to serve as the input node for receiving the vertical enable signal VEN.

Thus, it is during a period to generate the shift signal SR OUT (1) that the common transmission line SL is electrically connected to an input node formed on the AND gate 48-1 employed in the second logic circuit section 48 to serve as the input node for receiving the vertical enable signal VEN so that the vertical enable signal VEN is supplied to the selected AND gate 48-1. By the same token, it is during a period to generate the shift signal SR OUT (2) that the common transmission line SL is electrically connected to an input node formed on the AND gate 48-2 employed in the second logic circuit section 48 to serve as the input node for receiving the vertical enable signal VEN so that the vertical enable signal VEN is supplied to the selected AND gate 48-2. In the same way, it is during a period to generate the shift signal SR OUT (3) that the common transmission line SL is electrically connected to an input node formed on the AND gate 48-3 employed in the second logic circuit section 48 to serve as the input node for receiving the vertical enable signal VEN so that the vertical enable signal VEN is supplied to the selected AND gate 48-3. Likewise, it is during a period to generate the shift signal SR OUT (4) that the common transmission line SL is electrically connected to an input node formed on the AND gate 48-4 employed in the second logic circuit section 48 to serve as the input node for receiving the vertical enable signal VEN so that the vertical enable signal VEN is supplied to the selected AND gate 48-4. During each of the periods described above, one of the AND gates 48-1 to 48-4 employed in the second logic circuit section 48 is selected and the common transmission line SL is electrically connected to an input node formed on the selected AND gate to serve as the input node for receiving the vertical enable signal VEN. That is to say, the capacitor Ctr of the transistor employed in the selected one of the AND gates 48-1 to 48-4 employed in the second logic circuit section 48 is electrically connected by the activated one of respectively the Nch MOS transistors 47-1 to 47-4 employed in the switch section 47 to the common transmission line SL.

As explained earlier, the power consumed in electrical charging/discharging processes for every 1-H period is represented by an expression of $cv^2 \times f$ where notation c denotes the capacitance of a capacitor subjected to the electrical charging/discharging processes, notation v denotes the electrical charging/discharging voltage and notation f denotes the electrical charging/discharging frequency. The power consumption of the common transmission line SL can be found by setting the capacitance c at a value including the capacitance of the capacitors Ctr which are connected to the common transmission line SL. Since the number of capacitors Ctr connected to the common transmission line SL at a time is reduced to 1 as described above, the power consumption of the write scan circuit 40A can also be reduced as well. To put it more concretely, the power consumption of the write scan circuit 40A can be found by setting the capacitance c at a sum of line_C+(1×Ctr) where notation line_C denotes the line capacitance of the common transmission line SL and notation Ctr denotes the capacitance of the capacitor Ctr connected to the common transmission line SL. By the way, let notation m denote a row count which is the number of scan lines 31 employed in the pixel array section 30. In the case of a configuration in which the common transmission line SL is electrically connected to all input nodes each included in one of AND gates 48-1 to **48-*m* employed in the second logic circuit section 48 to serve as the input node for receiving the vertical enable signal VEN, the power consumption of the write scan circuit 40** can be found by setting the capacitance c at a sum of line_C+(m×Ctr).

Figure 22:
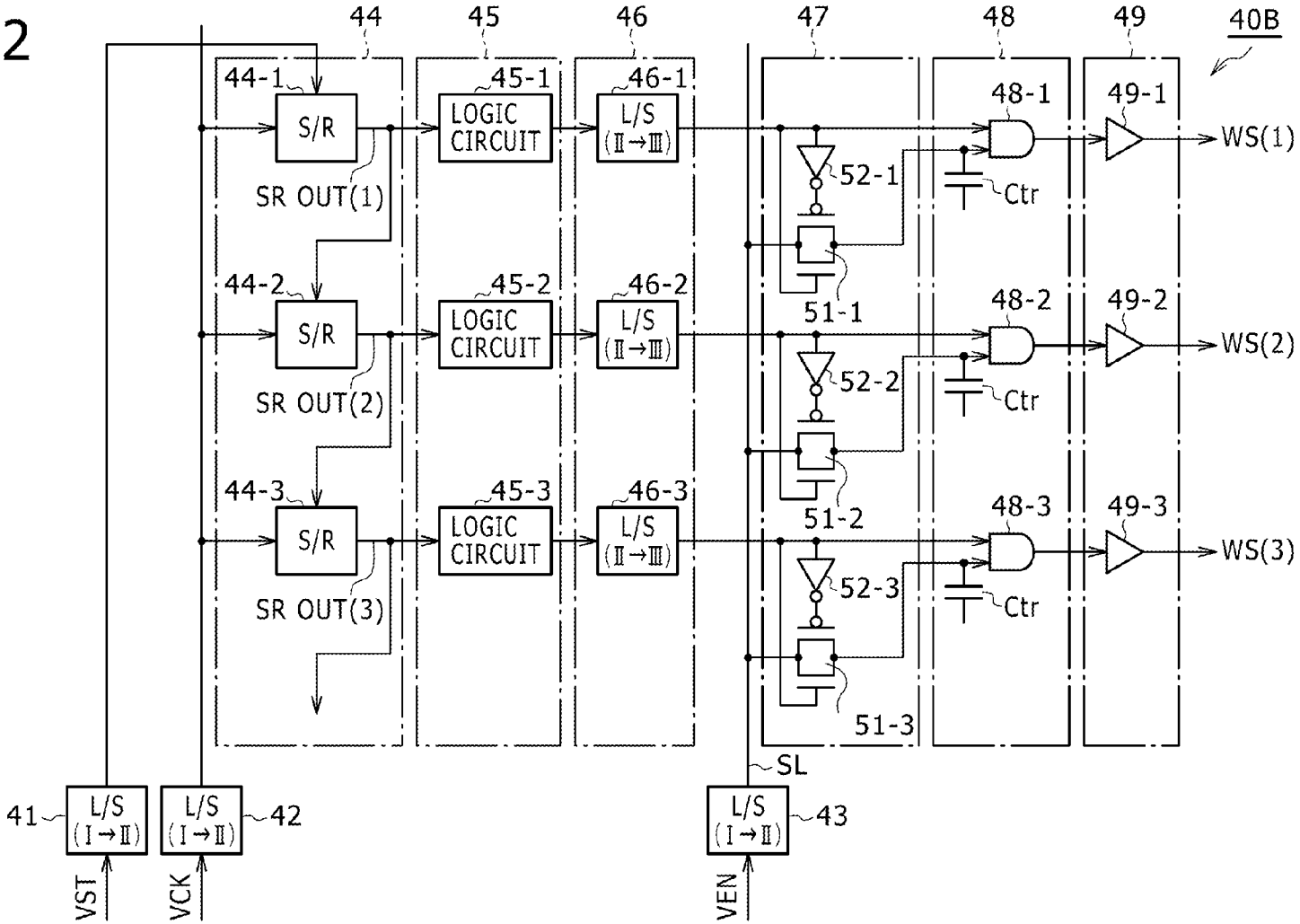
FIG. 22 is a block diagram showing a typical configuration of a write scan circuit according to a second embodiment.

That is to say, in comparison with a configuration in which the common transmission line SL is electrically connected to all input nodes each included in one of AND gates 48-1 to **48-*m* employed in the second logic circuit section 48 to serve as the input node for receiving the vertical enable signal VEN, the capacitance of a total load borne by the common transmission line SL employed in the write scan circuit 40A according to the first embodiment can be reduced to 1/m times the capacitance of a total load borne by the common transmission line SL employed in the configuration where notation m denotes a row count which is the number of scan lines 31 employed in the pixel array section 30. As a result, the power consumption of operations to electrically charge and discharge the vertical enable signal VEN onto and from the common transmission line SL, that is, the power consumption of the write scan circuit 40A according to the first embodiment can be reduced by $\{(m-1)\times Ctr\times cv^2\times f\}$ from $(m\times Ctr\times cv^2\times f)$ expressing the power consumption of the configuration in which the common transmission line SL is electrically connected to all input nodes each included in one of AND gates 48-1 to 48-*m* employed in the second logic circuit section 48 to serve as the input node for receiving the vertical enable signal VEN 2-2: Second Embodiment FIG. 22 is a block diagram showing a typical configuration of the write scan circuit 40B according to the second embodiment. In FIG. 22, components identical with their respective counterparts employed in the typical configuration shown in FIG. 10 are denoted by the same reference numerals as the counterparts and the identical components are not explained again in order to avoid duplications of descriptions. In order to make FIG. 22 simple, the typical configuration of the write scan circuit 40**B is shown to include sections provided for three pixel rows which start with the first pixel row.

By comparing the configuration shown in FIG. 10 with the configuration shown in FIG. 22, it becomes obvious that the difference between the write scan circuit 40B according to the second embodiment and the write scan circuit 40A according to the first embodiment is the configuration of the switch section 47. The remaining configuration elements of the write scan circuit 40B are identical with the remaining configuration elements of the write scan circuit 40A.

To put it more concretely, in the same way as the write scan circuit 40A, one of the AND gates 48-1 to 48-3 employed in the second logic circuit section 48 is selected by one of respectively switch devices 51-1 to 51-3 employed in the switch section 47 of the write scan circuit 40B and the common transmission line SL is electrically connected to an input node formed on the selected AND gate to serve as the input node for receiving the vertical enable signal VEN. In the case of the configuration of the write scan circuit 40B, however, each of the switch devices 51-1 to 51-3 employed in the switch section 47 is a pair of Pch and Nch CMOS transistors. The switch section 47 is thus configured to also employ inverters 52-1 to 52-3 for driving the Pch MOS transistors included in the switch devices 51-1 to 51-3 respectively. By employing the inverters 52-1 to 52-3 in the switch section 47 of the write scan circuit 40B according to the second embodiment, the switch section 47 of the write scan circuit 40B is capable of operating with a high degree of reliability in comparison with the switch section 47 of the write scan circuit 40A according to the first embodiment.

As described above, as each of the switch devices 51-1 to 51-3 of the write scan circuit 40B, a pair of Pch and Nch CMOS transistors is used in the switch section 47 of the write scan circuit 40B in place of every Nch MOS transistor employed in the switch section 47 of the write scan circuit 40A to serve as a switch device. Even in the case of the write scan circuit 40B according to the second embodiment, nevertheless, it is possible to demonstrate basically the same effects as the write scan circuit 40A according to the first embodiment. From the device-count point of view, however, the switch section 47 employed in the write scan circuit 40A is more advantageous than the switch section 47 employed in the write scan circuit 40B. That is to say, since the number of circuit devices employed in the switch section 47 of the write scan circuit 40A is smaller than the number of circuit devices employed in the switch section 47 of the write scan circuit 40B, the circuit configuration of the write scan circuit 40A can be made simpler than that of the write scan circuit 40B.

2-3: Third Embodiment

Figure 23:
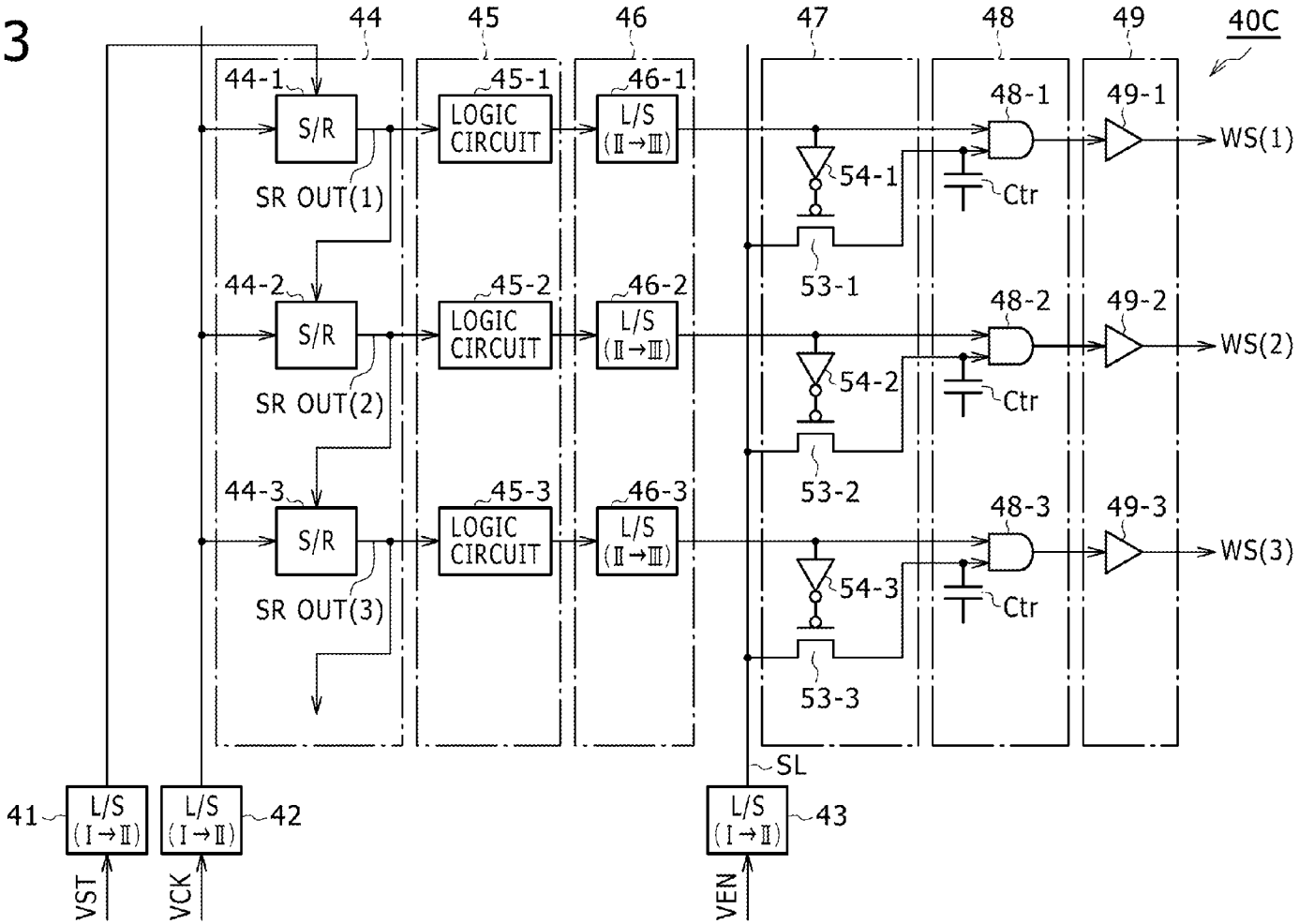
FIG. 23 is a block diagram showing a typical configuration of a write scan circuit according to a third embodiment.

FIG. 23 is a block diagram showing a typical configuration of the write scan circuit 40C according to the third embodiment. In FIG. 23, components identical with their respective counterparts employed in the typical configuration shown in FIG. 10 are denoted by the same reference numerals as the counterparts and the identical components are not explained again in order to avoid duplications of descriptions. In order to make FIG. 23 simple, the typical configuration of the write scan circuit 40C is shown to include sections provided for three pixel rows which start with the first pixel row.

By comparing FIG. 10 with FIG. 23, it becomes obvious that the difference between the write scan circuit 40C according to the third embodiment and the write scan circuit 40A according to the first embodiment is the configuration of the switch section 47. The remaining configuration elements of the write scan circuit 40C are identical with the remaining configuration elements of the write scan circuit 40A. To put it more concretely, in the same way as the write scan circuit 40A, one of the AND gates 48-1 to 48-3 employed in the second logic circuit section 48 is selected by one of respectively switch devices 53-1 to 53-3 employed in the switch section 47 of the write scan circuit 40C and the common transmission line SL is electrically connected to an input node formed on the selected AND gate to serve as the input node for receiving the vertical enable signal VEN. In the case of the configuration of the write scan circuit 40C, however, each of the switch devices 53-1 to 53-3 employed in the switch section 47 is a Pch CMOS transistor. The switch section 47 is thus configured to also employ inverters 54-1 to 54-3 for driving the Pch MOS transistors 53-1 to 53-3 respectively. By employing the inverters 54-1 to 54-3 in the switch section 47 of the write scan circuit 40C according to the third embodiment, the switch section 47 of the write scan circuit 40C is capable of operating in the same way as the switch section 47 of the write scan circuit 40A according to the first embodiment.

As described above, as each of the switch devices 53-1 to 53-3 employed in the write scan circuit 40C, a Pch CMOS transistor is used in the switch section 47 of the write scan circuit 40C in place of every Nch MOS transistor employed in the switch section 47 of the write scan circuit 40A to serve as a switch device. Even in the case of the write scan circuit 40C according to the third embodiment, nevertheless, it is possible to demonstrate basically the same effects as the write scan circuit 40A according to the first embodiment. From the device-count point of view, however, the switch section 47 employed in the write scan circuit 40A is more advantageous than the switch section 47 employed in the write scan circuit 40C which also has the inverters 54-1 to 54-3 in the switch section 47. That is to say, since the number of circuit devices employed in the switch section 47 of the write scan circuit 40A is smaller than the number of circuit devices employed in the switch section 47 of the write scan circuit 40C, the circuit configuration of the write scan circuit 40A can be made simpler than that of the write scan circuit 40C.

It is to be noted that the first, second and third embodiments implementing the write scan circuit 40A, the write scan circuit 40B and the write scan circuit 40C respectively are no more than preferred typical implementations. That is to say, the write scan circuit 40 described above is by no means limited to these embodiments. For example, the write scan circuit 40 can be configured to employ a decoder in place of the shift register section 44 and the decoder is used for outputting the write scan signals WS sequentially or randomly.

3: Modified Versions

In the embodiments described so far, the scan section according to the present invention is a row scan section for selecting pixel circuits 20 employed in the pixel array section 30 in pixel-row units. However, the present invention can also be applied as well to a column scan section for selecting pixel circuits 20 employed in the pixel array section 30 in pixel-column units.

In the case of the organic EL display apparatus 10 explained before, the signal outputting circuit 60 adopts a row-after-row sequential write driving technique for writing the signal voltage Vsig onto pixels for every pixel-row unit. Thus, the configuration of the organic EL display apparatus 10 does not desire a column scan section. If the display apparatus adopts a point-after-point sequential write driving technique for writing the signal voltage Vsig into each of pixels on a pixel row selected and scanned by the row scan section, on the other hand, it is necessary to provide the display apparatus with a column scan section for selecting pixel circuits 20 employed in the pixel array section 30 in pixel-column units. In this case, the present invention can also be applied to the column scan section as well.

In addition, each of the embodiments described above has a pixel configuration in which the circuit for driving the organic EL device 21 basically employs two transistors, i.e., the driving transistor 22 and the write transistor 23. However, the scope of the present invention is by no means limited to applications like such a pixel configuration.

Figure 24:
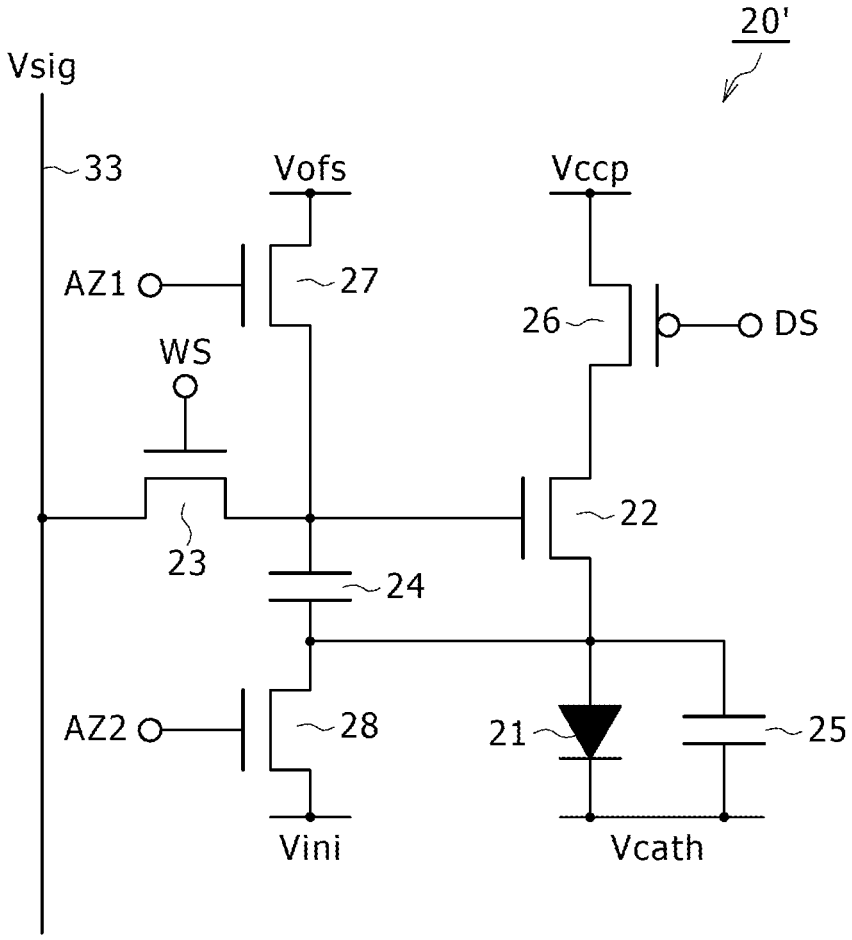
FIG. 24 is a circuit diagram showing another configuration of a pixel.

As an example, there is known a pixel circuit 20' which has a 5-Tr circuit configuration like one shown in FIG. 24 as a basic configuration. As shown in FIG. 24, the 5-Tr circuit configuration employs a light-emission control transistor 26 as well as switching transistors 27 and 28 in addition to the driving transistor 22 and the write transistor 23. For further information on this circuit configuration, the reader is suggested to refer to Japanese Patent Laid-open No. 2005-345722. In this circuit configuration, a Pch MOS transistor can be employed as the light-emission control transistor 26 whereas an Nch MOS transistor can be used as each of the switching transistors 27 and 28. However, any arbitrary combination of transistors having conduction types different from each other can also be used as the light-emission control transistor 26 as well as the switching transistors 27 and 28.

As shown in FIG. 24, the light-emission control transistor 26 is connected to the driving transistor 22 to form a series circuit. The light-emission control transistor 26 is a transistor for selectively supplying a high electric potential Vccp to the driving transistor 22 in order to control the organic EL device 21 to enter a state of emitting light or emitting no light. The switching transistor 27 is a transistor for selectively supplying the reference electric potential Vofs to the gate electrode of the driving transistor 22 in order to initialize a voltage Vg appearing on the gate electrode of the driving transistor 22 at the reference electric potential Vofs. The switching transistor 28 is a transistor for selectively supplying a low electric potential Vini to the source electrode of the driving transistor 22 in order to initialize a voltage Vs appearing on the source electrode of the driving transistor 22 at the low electric potential Vini.

The 5-Tr circuit configuration has been explained above as another configuration of a pixel circuit 20'. However, a variety of pixel configurations is conceivable. For example, it is possible to provide another typical pixel configuration in which the reference electric potential Vofs appearing on the signal line 33 is supplied to the pixel by way of the write transistor 23. The switching transistor 27 can thus be eliminated from this other typical pixel configuration.

As described above, each of the preferred typical embodiments implements an organic EL display apparatus 10 which employs organic EL devices 21 each used as the electro-optical device of a pixel circuit 20. However, the scope of the present invention is by no means limited to such preferred embodiments. To put it more concretely, the present invention can be applied to any display apparatus employing any electro-optical devices (each also referred to as a light emitting device) of a current-driven type as long as each of the electro-optical devices emits light at a luminance which varies in accordance with the magnitude of a current flowing through the electro-optical device. Typical examples of the electro-optical device (which is also referred to as a light emitting device) are an inorganic EL device, an LED device and a semiconductor laser device.

4: Application Examples

The display apparatus according to the embodiments of the present invention described above is typically employed in a variety of electronic instruments shown in diagrams of FIGS. 25 to 29 as instruments used in all fields. Typical examples of the electronic instruments are a digital camera, a notebook personal computer, a portable terminal (mobile device) such as a cellular phone and a video camera. In each of these electronic instruments, the display apparatus is used for displaying a video signal supplied thereto or generated therein as an image or a video.

As described above, by making use of the display apparatus according to the embodiments of the present invention to serve as the display apparatus of a variety of electronic apparatus in all fields, the quality of an image displayed by each of the electronic apparatus can be improved. In addition, the power consumption of the electronic apparatus can also be reduced as well. That is to say, as is obvious from the description of the embodiments, the display apparatus according to the embodiments of the present invention is capable of preventing the rising and falling timings of the scan signal from varying among a plurality of scan lines. It is thus possible to improve the quality of an image displayed by the display apparatus according to the embodiments of the present invention and reduce the power consumption of the scan section employed in the display apparatus. As a result, the power consumption of the electronic apparatus employing the display apparatus can also be decreased as well.

The display apparatus according to the embodiments of the present invention include an apparatus constructed into a modular shape with a sealed configuration. For example, the display apparatus according to the embodiments of the present invention is designed into a configuration in which the pixel matrix section 30 is implemented as a display module created by attaching the module to a facing unit made of a material such as transparent glass. On the transparent facing unit, components such as a color filter and a protection film can be created in addition to a shielding film described earlier. It is to be noted that the display module serving as the pixel matrix section 30 may include components such as a circuit for supplying a signal received from an external source to the pixel matrix section 30, a circuit for supplying a signal received from the pixel matrix section 30 to an external destination and an FPC (Flexible Print Circuit).

The following description explains concrete implementations of the electronic instruments to which the embodiments of the present invention are applied.

Figure 25:
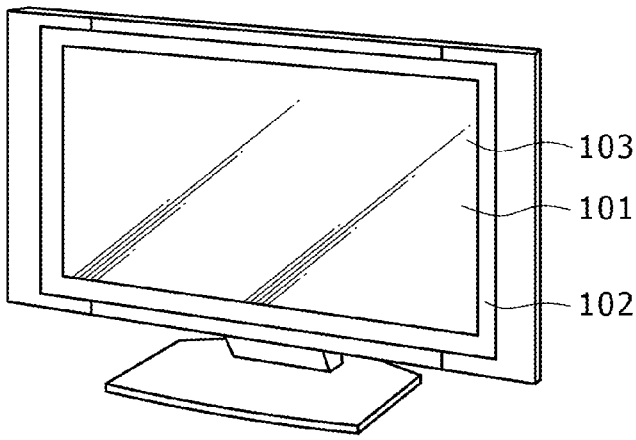
FIG. 25 is a diagram showing a squint view of the external appearance of a TV set to which the embodiments of the present invention is applied.

FIG. 25 is a diagram showing a squint view of the external appearance of a TV set to which the embodiments of the present invention are applied. The TV set serving as a typical implementation of the electronic instrument to which the embodiments of the present invention are applied employs a front panel 102 and a video display screen section 101 which is typically a filter glass plate 103. The TV set is constructed by employing the display apparatus provided by the embodiments of the present invention in the TV set as the video display screen section 101.

Figure 26A:
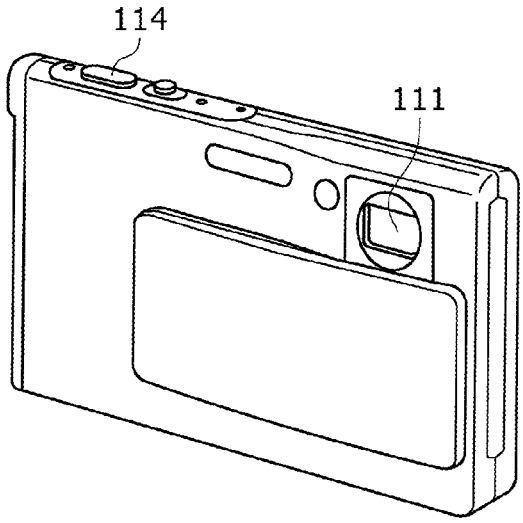
FIG. 26A is a diagram showing a squint view of the external appearance of the digital camera seen from a position on the front side of the digital camera.
Figure 26B:
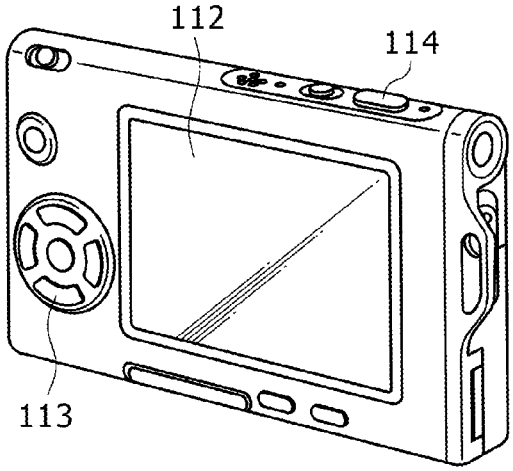
FIG. 26B is a diagram showing a squint view of the external appearance of the digital camera seen from a position on the rear side of the digital camera.

FIGS. 26A and 26B are a plurality of diagrams each showing a squint view of the external appearance of a digital camera to which the embodiments of the present invention are applied. To be more specific, FIG. 26A is a diagram showing a squint view of the external appearance of the digital camera seen from a position on the front side of the digital camera whereas FIG. 26B is a diagram showing a squint view of the external appearance of the digital camera seen from a position on the rear side of the digital camera. The digital camera serving as a typical implementation of the electronic instrument to which the embodiments of the present invention are applied employs a light emitting section 111 for generating a flash, a display section 112, a menu switch 113 and a shutter button 114. The digital camera is constructed by employing the display apparatus provided by the embodiments of the present invention in the digital camera as the display section 112.

Figure 27:
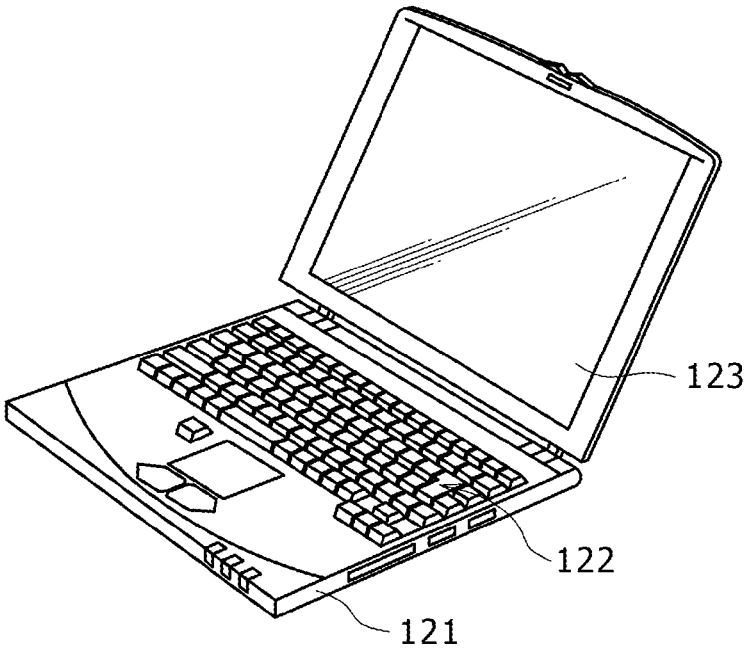
FIG. 27 is a diagram showing a squint view of the external appearance of a notebook personal computer to which the embodiments of the present invention is applied.

FIG. 27 is a diagram showing a squint view of the external appearance of a notebook personal computer to which the embodiments of the present invention are applied. The notebook personal computer serving as a typical implementation of the electronic instrument to which the embodiments of the present invention are applied employs a main body 121 including a keyboard 122 to be operated by the user for entering characters and a display section 123 for displaying an image. The notebook personal computer is constructed by employing the display apparatus provided by the embodiments of the present invention in the personal computer as the display section 123.

Figure 28:
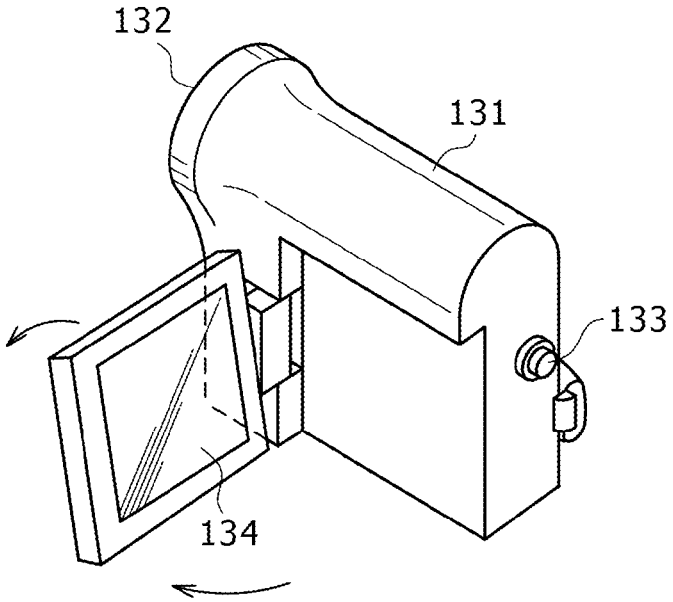
FIG. 28 is a diagram showing a squint view of the external appearance of a video camera to which the embodiments of the present invention is applied.

FIG. 28 is a diagram showing a squint view of the external appearance of a video camera to which the embodiments of the present invention are applied. The video camera serving as a typical implementation of the electronic instrument to which the embodiments of the present invention are applied employs a main body 131, a photographing lens 132, a start/stop switch 133 and a display section 134. Provided on the front face of the video camera, the photographing lens 132 oriented in the forward direction is a lens for taking a picture of a subject of photographing. The start/stop switch 133 is a switch to be operated by the user to start or stop a photographing operation. The video camera is constructed by employing the display apparatus provided by the embodiments of the present invention in the video camera as the display section 134.

Figures 29A, 29B, 29C, 29D, 29E, 29F, 29G:
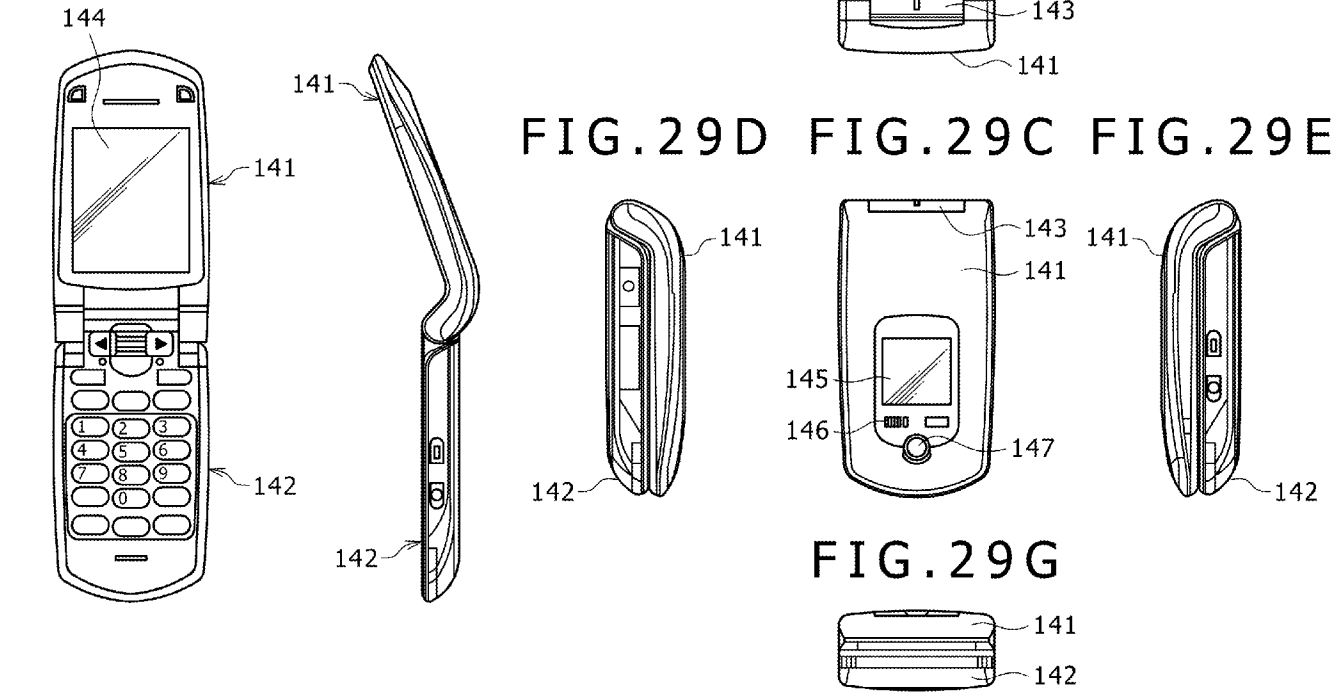
FIG. 29A is a diagram showing the front view of the cellular phone in a state of being already opened.
FIG. 29B is a diagram showing a side of the cellular phone in a state of being already opened.
FIG. 29C is a diagram showing the front view of the cellular phone in a state of being already closed.
FIG. 29D is a diagram showing the left side of the cellular phone in a state of being already closed.
FIG. 29E is a diagram showing the right side of the cellular phone in a state of being already closed.
FIG. 29F is a diagram showing the top view of the cellular phone in a state of being already closed.
FIG. 29G is a diagram showing the bottom view of the cellular phone in a state of being already closed.
Figure 30:
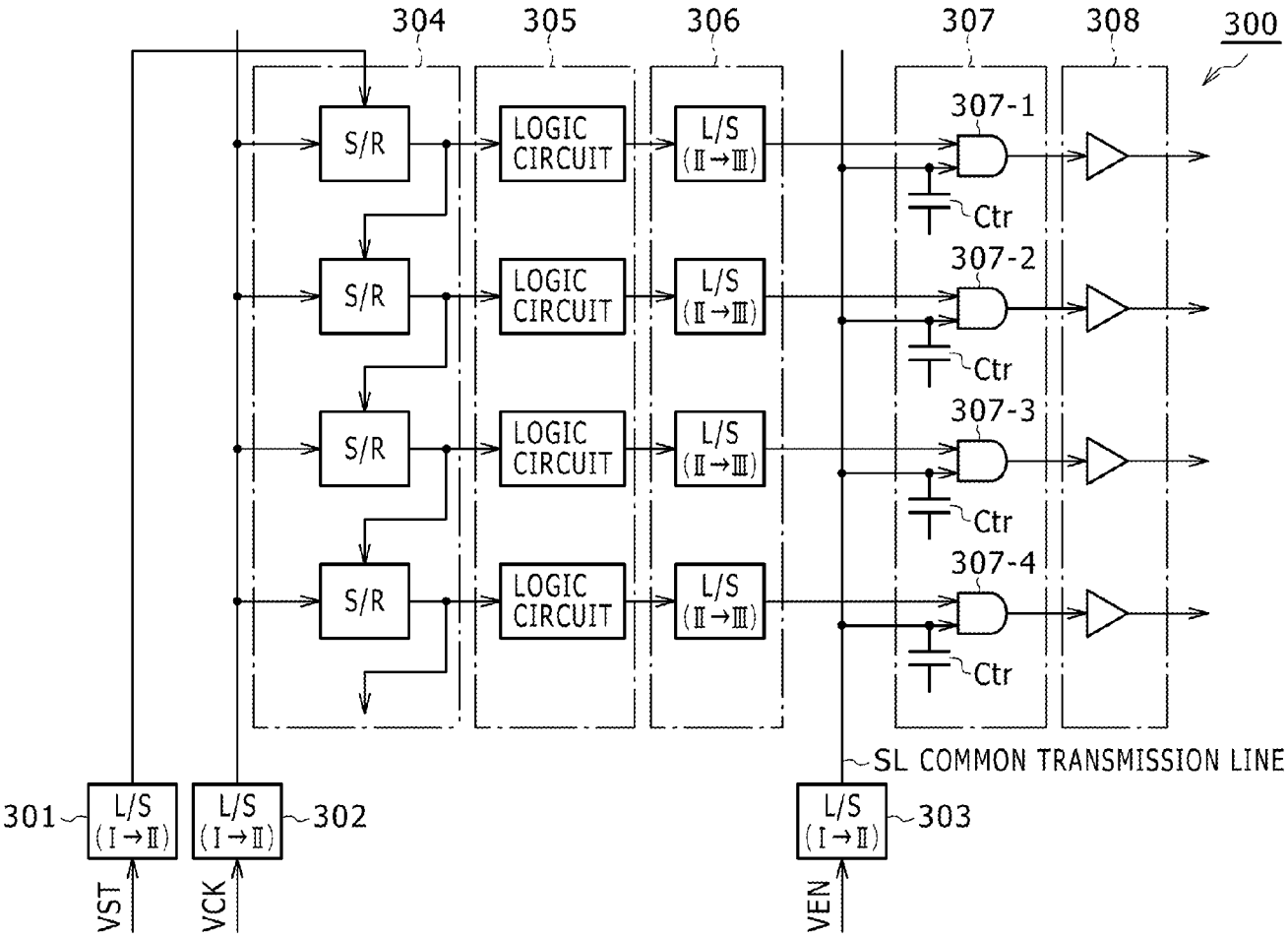
FIG. 30 is a block diagram showing a typical configuration of the existing row scan circuit.

FIGS. 29A to 29G are a plurality of diagrams each showing the external appearance of a portable terminal such as a cellular phone to which the embodiments of the present invention are applied. To be more specific, FIG. 29A is a diagram showing the front view of the cellular phone in a state of being already opened. FIG. 29B is a diagram showing a side of the cellular phone in a state of being already opened. FIG. 29C is a diagram showing the front view of the cellular phone in a state of being already closed. FIG. 29D is a diagram showing the left side of the cellular phone in a state of being already closed. FIG. 29E is a diagram showing the right side of the cellular phone in a state of being already closed. FIG. 29F is a diagram showing the top view of the cellular phone in a state of being already closed. FIG. 29G is a diagram showing the bottom view of the cellular phone in a state of being already closed. The cellular phone serving as a typical implementation of the electronic instrument to which the embodiments of the present invention are applied employs an upper case 141, a lower case 142, a link section 143 which is a hinge, a display section 144, a display sub-section 145, a picture light 146 and a camera 147. The cellular phone is constructed by employing the display apparatus provided by the embodiments of the present invention in the cellular phone as the display section 144 and/or the display sub-section 145.

The present application contains subject matter related to that disclosed in Japanese Priority Patent Application JP 2009-134786 filed in the Japan Patent Office on Jun. 4, 2009, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A display apparatus, comprising:

a plurality of pixels, wherein each pixel comprises a light emitting element;

a driving circuit configured to control selection of pixels, the driving circuit comprising:

a circuit including a first input terminal and a second input terminal; and a switch transistor including a gate terminal configured to receive a reference signal, a second terminal configured to receive an enable signal, and a third terminal, wherein the first input terminal of the circuit is connected to the gate terminal of the switch transistor, wherein the second input terminal of the circuit is connected to the third terminal of the switch transistor, wherein a pulse width of the enable signal is shorter than a horizontal scan period, and wherein the switch transistor is configured to provide a part of the enable signal to the second input terminal of the circuit when the switch transistor is in a conductive state.

2. The display apparatus of claim 1, wherein the light emitting element is an organic EL device, at least one of the plurality of pixels includes a first transistor, a second transistor, and a pixel capacitor, the first transistor is configured to supply a video signal to the pixel capacitor, the second transistor is configured to drive the light emitting element according to the video signal, and the driving circuit is configured to supply a scan signal to a gate terminal of the second transistor.

3. The display apparatus of claim 2, wherein at least one of the plurality of pixels further includes a third transistor, a fourth transistor, and fifth transistor, a gate terminal of the second transistor is connected to a reference potential via the fourth transistor, a second terminal of the second transistor is connected to a first potential via the third transistor, and an anode of the light emitting element is connected to a second potential via the fifth transistor.

4. The display apparatus of claim 1, wherein at least one of the plurality of pixels includes a first transistor, a second transistor, and a pixel capacitor, the first transistor is configured to supply a video signal to the pixel capacitor, the second transistor is configured to drive the light emitting element according to the video signal, and the driving circuit is configured to supply a scan signal to a gate terminal of the first transistor.

5. The display apparatus of claim 4, wherein at least one of the plurality of pixels further includes a third transistor, a fourth transistor, and fifth transistor, a gate terminal of the second transistor is connected to a reference potential via the fourth transistor, a second terminal of the second transistor is connected to a first potential via the third transistor, and an anode of the light emitting element is connected to a second potential via the fifth transistor.

6. The display apparatus of claim 1, wherein the circuit comprises an AND gate that generates a scan signal for a first line of pixels.

7. An electronic instrument, comprising:

a display apparatus comprising a plurality of pixels, wherein each pixel comprises a light emitting element;

a driving circuit configured to control selection of pixels, the driving circuit comprising:

a circuit including a first input terminal and a second input terminal; and a switch transistor including a gate terminal configured to receive a reference signal, a second terminal configured to receive an enable signal, and a third terminal, wherein the first input terminal of the circuit is connected to the gate terminal of the switch transistor, wherein the second input terminal of the circuit is connected to the third terminal of the switch transistor, wherein a pulse width of the enable signal is shorter than a horizontal scan period, and wherein the switch transistor is configured to provide a part of the enable signal to the second input terminal of the circuit when the switch transistor is in a conductive state.

8. The display apparatus of claim 7, wherein the light emitting element is an organic EL device, at least one of the plurality of pixels includes a first transistor, a second transistor, and a pixel capacitor, the first transistor is configured to supply a video signal to the pixel capacitor, the second transistor is configured to drive the light emitting element according to the video signal, and the driving circuit is configured to supply a scan signal to a gate terminal of the second transistor.

9. The display apparatus of claim 8, wherein at least one of the plurality of pixels further includes a third transistor, a fourth transistor, and fifth transistor, a gate terminal of the second transistor is connected to a reference potential via the fourth transistor, a second terminal of the second transistor is connected to a first potential via the third transistor, and an anode of the light emitting element is connected to a second potential via the fifth transistor.

10. The display apparatus of claim 7, wherein at least one of the plurality of pixels includes a first transistor, a second transistor, and a pixel capacitor, the first transistor is configured to supply a video signal to the pixel capacitor, the second transistor is configured to drive the light emitting element according to the video signal, and the driving circuit is configured to supply a scan signal to a gate terminal of the first transistor.

11. The display apparatus of claim 10, wherein at least one of the plurality of pixels further includes a third transistor, a fourth transistor, and fifth transistor, a gate terminal of the second transistor is connected to a reference potential via the fourth transistor, a second terminal of the second transistor is connected to a first potential via the third transistor, and an anode of the light emitting element is connected to a second potential via the fifth transistor.

12. The display apparatus of claim 7, wherein the circuit comprises an AND gate that generates a scan signal for a first line of pixels.

* * * * *